US008648242B2

(12) United States Patent
Liotta

(10) Patent No.: US 8,648,242 B2
(45) Date of Patent: Feb. 11, 2014

(54) INTERACTIVE ELECTRONIC APPAREL INCORPORATING A KEYBOARD IMAGE

(75) Inventor: Tyson Liotta, Fairfax, VA (US)

(73) Assignee: ThinkGeek, Inc., Fairfax, VA (US)

( * ) Notice: Subject to any disclaimer, the term of this patent is extended or adjusted under 35 U.S.C. 154(b) by 436 days.

(21) Appl. No.: 13/024,973

(22) Filed: Feb. 10, 2011

(65) Prior Publication Data

US 2011/0197333 A1 Aug. 18, 2011

Related U.S. Application Data

(60) Provisional application No. 61/304,127, filed on Feb. 12, 2010.

(51) Int. Cl.
*G10H 7/00* (2006.01)

(52) U.S. Cl.
USPC ..... 84/615; 84/653; 2/90

(58) Field of Classification Search
USPC ..... 84/615, 653; 2/90
See application file for complete search history.

(56) References Cited

U.S. PATENT DOCUMENTS

| | | | | |
|---|---|---|---|---|
| 2,582,699 | A | 1/1952 | Jelaso et al. | |
| 4,466,136 | A * | 8/1984 | Bottom et al. | 2/115 |
| 4,525,878 | A | 7/1985 | Lowe, Jr. | |
| 4,570,206 | A | 2/1986 | Deutsch | |
| 4,635,516 | A | 1/1987 | Giannini | |
| 4,860,364 | A | 8/1989 | Giannini | |
| 4,875,238 | A * | 10/1989 | Solomon et al. | 2/115 |
| 5,222,259 | A | 6/1993 | Bristor | |
| 5,455,749 | A | 10/1995 | Ferber | |
| 5,551,065 | A | 8/1996 | Honore | |
| 5,626,948 | A | 5/1997 | Ferber et al. | |
| 5,845,335 | A | 12/1998 | Twitty | |
| 5,973,420 | A * | 10/1999 | Kaiserman et al. | 307/139 |
| 6,311,350 | B1 | 11/2001 | Kaiserman et al. | |
| 6,395,121 | B1 | 5/2002 | De Bastiani | |
| 6,755,713 | B1 | 6/2004 | Weber et al. | |
| 6,819,771 | B2 * | 11/2004 | Menzies | 381/333 |
| 7,065,909 | B2 | 6/2006 | Snyder | |
| 7,831,933 | B2 | 11/2010 | Marggraff et al. | |
| 7,861,188 | B2 | 12/2010 | Josephsoon et al. | |
| 7,922,099 | B1 | 4/2011 | Schmidt et al. | |
| 8,008,606 | B2 | 8/2011 | Kaiserman et al. | |
| 2002/0170411 | A1 | 11/2002 | Geisen | |
| 2005/0034591 | A1 | 2/2005 | Chang | |

(Continued)

OTHER PUBLICATIONS

Think Geek, Electronic Drum Kit Shirt. Product Catalog Listing [online]. Think Geek. Feb. 7, 2009 [retrieved on Mar. 22, 2011]. Retrieved from the Internet: <URL: http://replay.waybackmachine.org/20090207075409/http://www.thinkgeek.com/tshirts-apparel/interactive/ac0b> entire document.

(Continued)

*Primary Examiner* — Jeffrey Donels
(74) *Attorney, Agent, or Firm* — Dergosits & Noah LLP; Geoffrey T. Staniford

(57) ABSTRACT

Embodiments are directed to a novel technique used to create electronic apparel that is powered by batteries and generates light, or sound in reaction to various sensors on the garment. The wearer through the use of various options or effects can further modify the output through the use of various options or effects. The electronic apparel includes an image of an instrument and a keypad that allows for user control of sounds generated by electronic circuits incorporated in the garment. Sound generation circuitry and speakers are coupled to the keypad in an electronic assembly that is detachably coupled to the garment in such a way as to allow regular washing of the garment without any damage to the electronic devices.

18 Claims, 17 Drawing Sheets

(56) References Cited

U.S. PATENT DOCUMENTS

| | | | |
|---|---|---|---|
| 2008/0191864 | A1 | 8/2008 | Wolfson |
| 2009/0095094 | A1 | 4/2009 | Helmer et al. |
| 2011/0197334 | A1 | 8/2011 | Liotta |
| 2011/0197742 | A1 | 8/2011 | Liotta |
| 2011/0226115 | A1 | 9/2011 | Dangerfield |
| 2011/0265631 | A1 | 11/2011 | Sanchez |
| 2012/0069486 | A1 | 3/2012 | Lee et al. |

OTHER PUBLICATIONS

Think Geek, Electronic Rock Guitar Shirt. Product Catalog Listing [online]. Think Geek. Feb. 7, 2009 [retrieved on Mar. 22, 2011]. Retrieved from the Internet: <URL: http://replay.waybackmachine.org/20090207075409/http://www.thinkgeek.com/tshirts-apparel/interactive/ac0b> entire document.

Think Geek. T-Qualizer Shirt. Product Catalog Listing [online]. Think Geek. Jan. 23, 2009 [retrieved on Mar. 24, 2011]. Retrieved from the Internet: <URL: http://replay.waybackmachine.org/20090123223521/http://www.thinkgeek.com/tshirts-apparel/interactive/8a5bb> entire document.

PCT Search Report and Written Opinion for International Application No. PCT/US2011/024364; Mailed Apr. 28, 2011; pp. 1-21.

Non-Final Office Action for U.S. Appl. No. 13/024,931; Mailed Jun. 18, 2012; pp. 1-5.

* cited by examiner

INTERACTIVE ELECTRONIC APPAREL INCORPORATING A KEYBOARD IMAGE

CROSS-REFERENCE TO RELATED APPLICATIONS

The present application claims the benefit of the U.S. Provisional Application No. 61/304,127 entitled "Interactive Electronic Apparel," and filed on Feb. 12, 2010.

FIELD

Embodiments of the invention relate generally to clothing and apparel that incorporates electronic circuits for generating sound and other electrical signals.

BRIEF DESCRIPTION OF THE DRAWINGS

Embodiments of the present invention are illustrated by way of example and not limitation in the figures of the accompanying drawings, in which like references indicate similar elements and in which.

DETAILED DESCRIPTION

Figure 1:
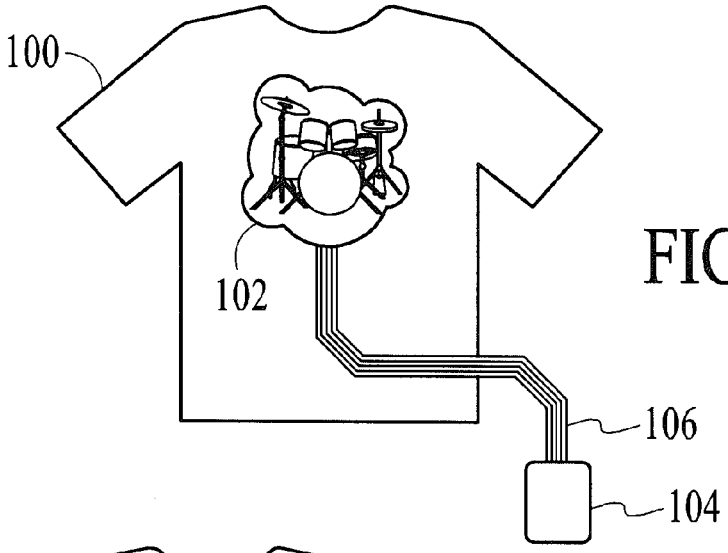
FIG. 1 illustrates a t-shirt that features a drum kit which can be played by the wearer, under an embodiment.

Embodiments are directed to garments, apparel, and other items of fabric that incorporate electronic circuits that are battery-powered and generate light, or sound in reaction to user input to various switches or sensors on the garment. The garment may incorporate an interactive image of a musical instrument, such as a guitar, keyboard, drum set, or other musical instrument. The instrument image includes a keypad that generates notes or sounds upon contact by the user. The garment is designed to be operated as it is worn by the user, and he or she can further modify the output through the use of various options or effects. Input and output devices are connected electronically. The output devices can include audio output components, such as an amplifier or speaker circuit, as well as visual output components, such as light arrays. The entire electronic apparatus is affixed to the garment in such a way as to allow regular washing of the garment without any damage to the electronic devices.

In an embodiment, the wearer will use the interactive electronic apparel by activating an input sensor. The activated input sensors will cause electronic sounds and/or lights to be generated from the connected output device. The entire assembly, including input sensors, connecting medium and output devices may be affixed or connected to the apparel.

The apparel or garment can be any suitable piece of clothing, such as a shirt, sweater, coat, dress, apron, and so on, and made of any appropriate material such as cotton, polyester, and so on. Any of the terms "garment," "clothing," "apparel," "shirt," and the like may be used interchangeably to refer to a wearable object or piece of cloth that incorporates switches and circuitry in accordance with embodiments described herein. Sounds and/or other output, such as lights, are actuated by user input provided by switches embedded within the garment, and are output through speakers, LEDs (Light Emitting Diodes), or other devices that are attached to or embedded within the garment, or provided externally. Power to the electronic circuits within the garment and the output devices can be provided by batteries, also embedded or attached to the garment. Alternative energy sources, such as solar devices may also be used.

In an embodiment, the electronic garment incorporates graphical representations of musical instruments that can be "played" by the user touching appropriate parts of the garment to generate sounds corresponding to the pictured instrument. For example, a keyboard shirt can have an image or picture of a keyboard or piano that the user plays by pressing keys on the shirt. The appropriate piano or keyboard sound is then played through an amplifier and speakers within or attached to the shirt. Other instruments are also possible, such as guitar, drums, saxophone, accordion, and so on. The graphical representation on the surface of the garment may be provided in the form of a sew-on or iron-on or heat applied decal, an embroidered picture, a printed picture, or any other similar means. The term instrument "image" is thus meant to cover a picture or representation of the instrument and may be embodied on a plastic, fabric, paper, or similar material that is attached or affixed, sewn into, or otherwise incorporated into the fabric of the garment. The instrument image may be coupled to or incorporated with a keypad switch matrix that allows the user to press one or more switches to generate sounds corresponding to the instrument image.

The following description includes embodiments for three examples of interactive electronic apparel that incorporate a musical instrument image for user input and amp/speaker circuits for audio output. Any of the shirts illustrated in FIGS. 1-3 may be implemented in a t-shirt, polo shirt, sweater or any similar garment.

Drum Kit Shirt

Figure 4:
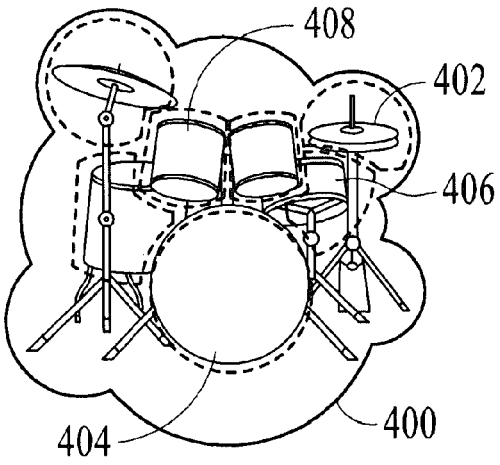
FIG. 4 illustrates the layout of the sensor buttons of a drum shirt, under an embodiment.
Figure 12:
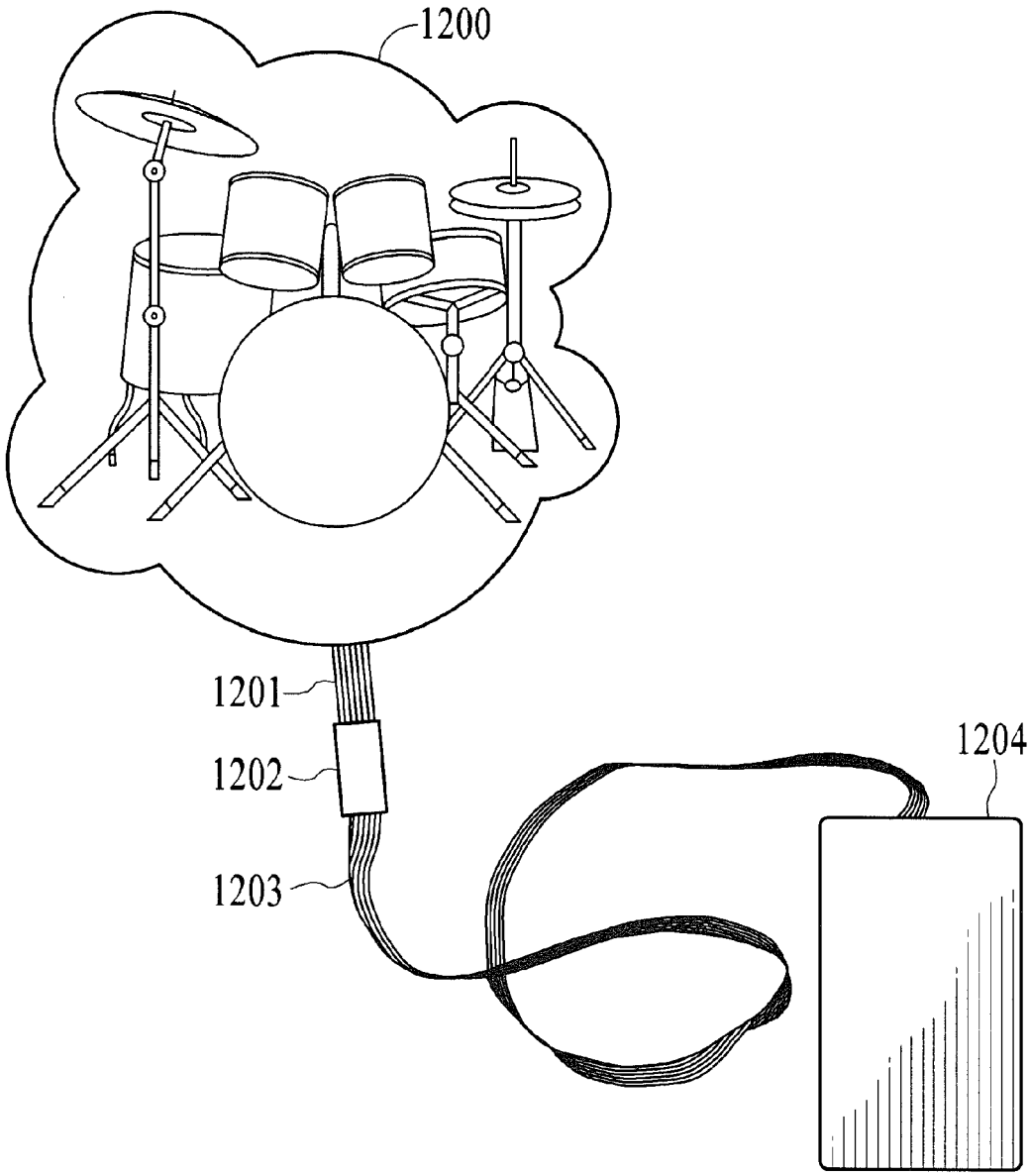
FIG. 12 illustrates the main components of the drum t-shirt illustrating the button panel, electronics and battery box and ribbon cable, prior to incorporation in the t-shirt or garment.

FIG. 1 illustrates a t-shirt that features a drum kit which can be played by the wearer. The t-shirt 100 has imprinted or incorporated on it an image of a drum kit 102. The drum kit image is attached to a speaker and battery box 104 through cable assembly 106. The cable assembly 106 is typically placed on the inside of the shirt and the speaker and battery box can be hidden under the shirt and held in an interior pocket or otherwise attached to the wearer, such as on a belt, so that they are not readily visible. The wearer (user) plays the drums by pressing down on sensors located on each drum. These buttons employ a flexible membrane sensor to detect touch. Each drum will play a select sound when activated. FIG. 4 illustrates the layout of the sensor buttons of a drum shirt, under an embodiment. As shown in FIG. 4, the drum kit image 400 includes a number of different sensor button areas 402-408 that represent the different elements in a typical drum kit, and that are indicated through dashed line regions in the image. Each sensor button creates a different drum sound, such as bass drum 404, tom tom 408, cymbal 402, snare 406, and so on. The output sounds are heard through a built-in speaker 104 contained in an interior pocket of the shirt. All electronics are able to be removed from the shirt to facilitate washing. The electronics can be connected to the shirt using hook and loop (e.g., Velcro) fasteners so that they may be easily replaced by the user when washing is finished. In an embodiment, the switches for the drum are implemented through on/off spring loaded (momentary) switches. Alternatively, a switch incorporating velocity sensitivity can be used to implement volume control through intensity of hitting a drum. FIG. 12 illustrates the main components of the drum t-shirt illustrating the button panel, electronics and battery box and ribbon cable coupling the components together, prior to incorporation in the t-shirt or garment. As shown in the embodiment of FIG. 12, the drum kit image 1200 that incorporates the button panel is coupled through a cable 1201 to a ribbon cable 1203. The ribbon cable 1203 is detachable from cable 1201 through coupling 1202 so that the battery/electronics and speaker box 1204 can be removed from the shirt. During normal use, the battery/speaker box 1204 is kept in an internal pocket of the shirt.

Guitar Shirt

Figure 2:
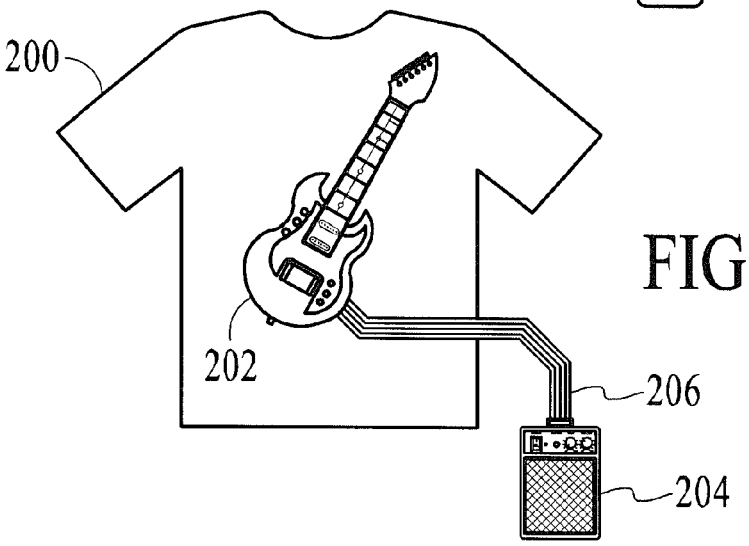
FIG. 2 illustrates a t-shirt that features a guitar which can be played by the wearer, under an embodiment.

FIG. 2 illustrates a t-shirt that features a guitar which can be played by the wearer. The t-shirt 200 has imprinted or incorporated on it an image of a guitar 202. The guitar image is attached to a speaker and battery box 204 through cable assembly 206. The cable assembly 206 is typically placed on the inside of the shirt and the speaker and battery box can be hidden under the shirt and held in an interior pocket or otherwise attached to the wearer, such as on a belt, so that they are not readily visible. In an embodiment, the speaker 204 is a decorative speaker that is configured to miniature version of a full size guitar amp. In this case, the amplifier 204 can be hooked on the wearer's belt or hung from his/her shoulder. The guitar image 202 includes the body of the guitar with one or more pickups, the guitar neck, and the guitar headstock, along with other graphical elements, such as strings, switches, graphic designs, and the like. The guitar neck portion represents the fret board and includes frets and optional dot inlays as can be seen on a real guitar.

Figure 5:
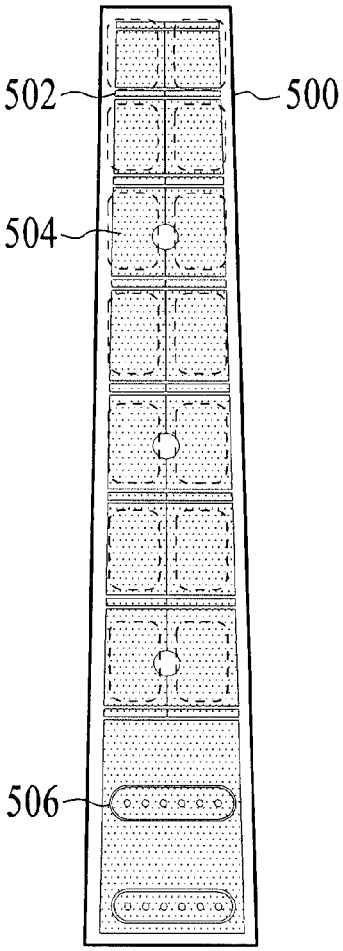
FIG. 5 illustrates the layout of the sensors and switches of the guitar, under an embodiment.

The wearer plays the guitar 202 by pressing the buttons on the neck of the guitar to select specific chords or notes. These buttons employ a flexible membrane sensor to detect touch. FIG. 5 illustrates the layout of the sensors and switches of the guitar. In an embodiment, the guitar neck includes a number of button regions 504 that are organized into areas defined by the frets 502. One or more pickup regions 506 can also be included. Each button creates a different pitch and is actuated by a user pressing down on the appropriate button region. Sounds are generated through a built in speaker contained in a case which can be made to look like a miniature guitar amp. This amp can be stored in an internal pocket inside the shirt or worn on the belt with the attached clip.

Figure 8:
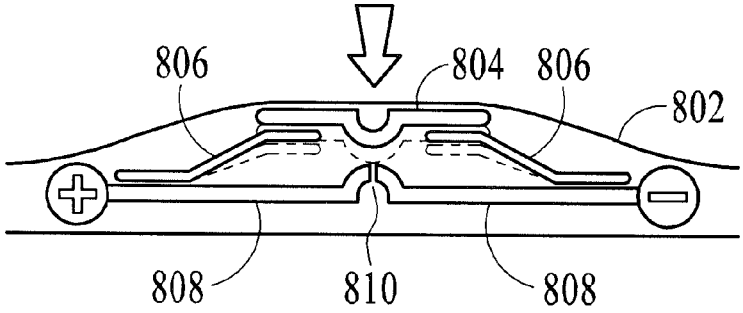
FIG. 8 illustrates a flexible membrane sensor to detect touch for use in conjunction with an interactive electronic apparel, under an embodiment.

In one embodiment, these button regions include a flexible membrane sensor to detect touch. FIG. 8 illustrates a flexible membrane sensor, under an embodiment. The sensor switch is encased within a body 802 and includes a conductive actuator 804 that is held in a normally off position by springs 806. When the user depresses the actuator 804 by pressing down, it makes contact with the electrodes 808 and shorts the gap 810 between the positive and negative terminals of the electrodes, thus closing the switch. The springs 806 could be made of plastic or any similar flexible material. The guitar shirt can be configured to produce a sound simply by the user closing the switch, and the duration of the note is determined by the amount of time that the user presses down on the switch. Alternatively, the guitar shirt can be configured to produce a sound only when the user presses a switch and then strums across the "strings" of the guitar in the vicinity of the pickup images.

Figure 7:
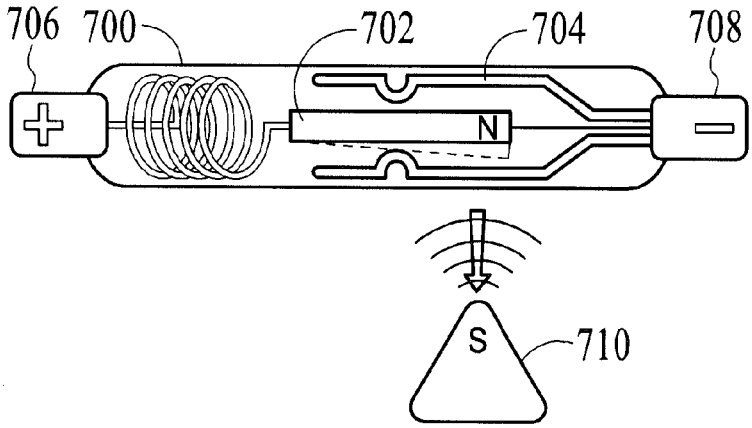
FIG. 7 illustrates a magnetic reed switch to detect strumming for use in conjunction with a guitar shirt, under an embodiment.

For the embodiment in which the act of strumming the guitar across the pictures strings will produce the electronic sound, the strumming action is detected by a magnetic reed switch, which is placed in the proximity of the strumming area of the guitar. FIG. 7 illustrates a magnetic reed switch to detect strumming for use in conjunction with a guitar shirt, under an embodiment. The reed switch 700 includes a magnet 702 connected to the positive terminal 706 of an electrode. When the magnet is actuated it contacts the negative terminal 708 of the electrode through contacts 704. A special guitar pick 710, which is included with the device, also contains a magnet. The reed switch detects this magnet and triggers the guitar sound. The reed switch may be implemented through any type of proximity or motion sensing switch, such as an optical sensor, ultrasonic range finder, sound sensor, or any similar type of motion/proximity detector.

For the embodiment of FIG. 7, the sensor represented as a pickup is a reed switch that is operated by an applied magnetic field. The switch consists of a pair of contacts on ferrous metal reeds in a hermetically sealed glass envelope. The contacts may be normally open, closing when a magnetic field is present, or normally closed and opening when a magnetic field is applied. The switch may be actuated by a coil, making a reed relay, or by bringing a magnet near to the switch. Once the magnet is pulled away from the switch, the reed switch will go back to its original position. The switch may be embodied within similar activation switches, such as a Hall Effect sensor, which is a transducer that varies its output voltage in response to changes in magnetic field, or an inductive sensor, which is an electronic proximity sensor that detects metallic objects without touching them. The pickup sensor may also be embodied as a physical sensor that the user touches and strums across directly to produce the sound.

As shown in FIG. 5, the guitar shirt includes a number of sensor areas 504, such as 14 or more sensors, each of which produce a single note within the standard musical scale. These sensor areas within the neck portion comprise the keypad that corresponds to the fret board of the guitar. The guitar shirt may be played monophonically in which only a single note may be depressed at a time to sound one note at a time, or polyphonically in which multiple notes can be pressed simultaneously to play chords. Alternatively, each sensor can be configured to play a particular chord, e.g., Amaj, Amin, $A^b$maj, $A^b$min, and so on. Any number of different chords can be programmed, depending on the number of sensors provided. For example, with 14 sensors major and minor chords for each note A-G can be programmed, or just the major chords for the natural and flatted notes A-G can be programmed, and so on. Other buttons or switches can also be provided to alter the sound of the guitar to change notes, add effects (e.g., distortion, delay, etc), play backing tracks, and so on. The strumming area of the guitar where the magnetic reed switch 700 resides to sense the user strumming with the magnetic pick is denoted by graphic area illustrating one or more guitar pickups 506. When the user pushes a pad on the shirt (on the neck of the guitar) to actuate the membrane switch 802 and then strums the shirt with the magnetic pick 710, the circuit will play the corresponding chord. The guitar chords are pre-set samples. In an embodiment, it is configured to play up to 15 different chords that are programmed as simple rock "power chords" to enable playing many popular rock songs. Many other chord configurations are also possible.

Figure 13:
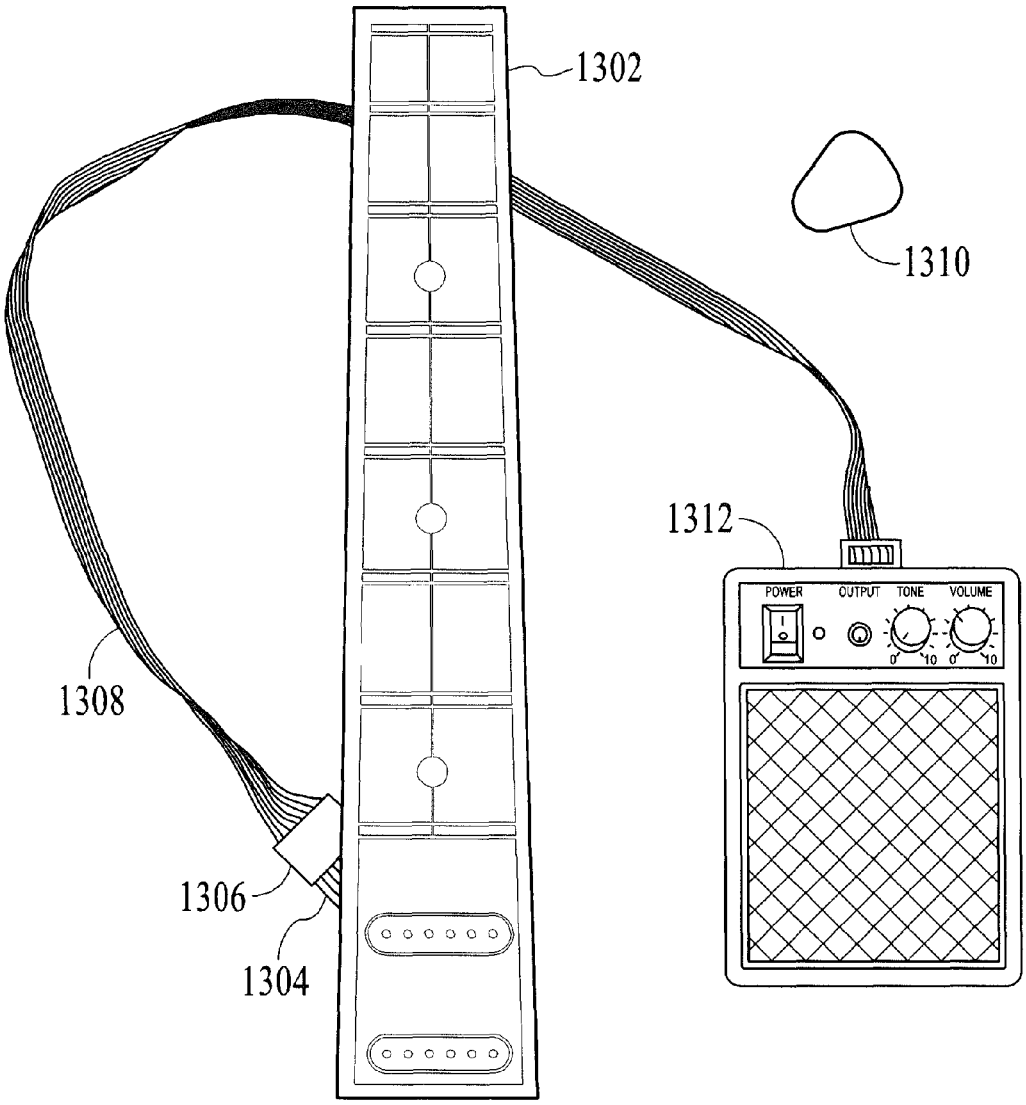
FIG. 13 illustrates the main components of the guitar t-shirt illustrating the button panel, electronics and battery box and ribbon cable, prior to incorporation in the t-shirt or garment.

FIG. 13 illustrates the main components of the guitar t-shirt, under an embodiment. As shown in FIG. 13, the main components include the neck 1302 that incorporates a button panel and a pickup area. This is connected to a wearable mini amplifier 1312 through ribbon cable 1308 that is detachably coupled through interface 1306 to cable 1304. This allows the amp, electronics and battery box and ribbon cable to be removed from the t-shirt when necessary. Thus, all of the electronics are able to be removed from the shirt to facilitate washing. In an embodiment, the electronics are connected to the shirt using hook and loop fasteners so that they may be easily replaced by the user when washing is finished. The magnetic pick 1310 is used to "strum" the guitar and produce the sounds corresponding to the switch areas pressed on the button panel 1302.

Figure 16:
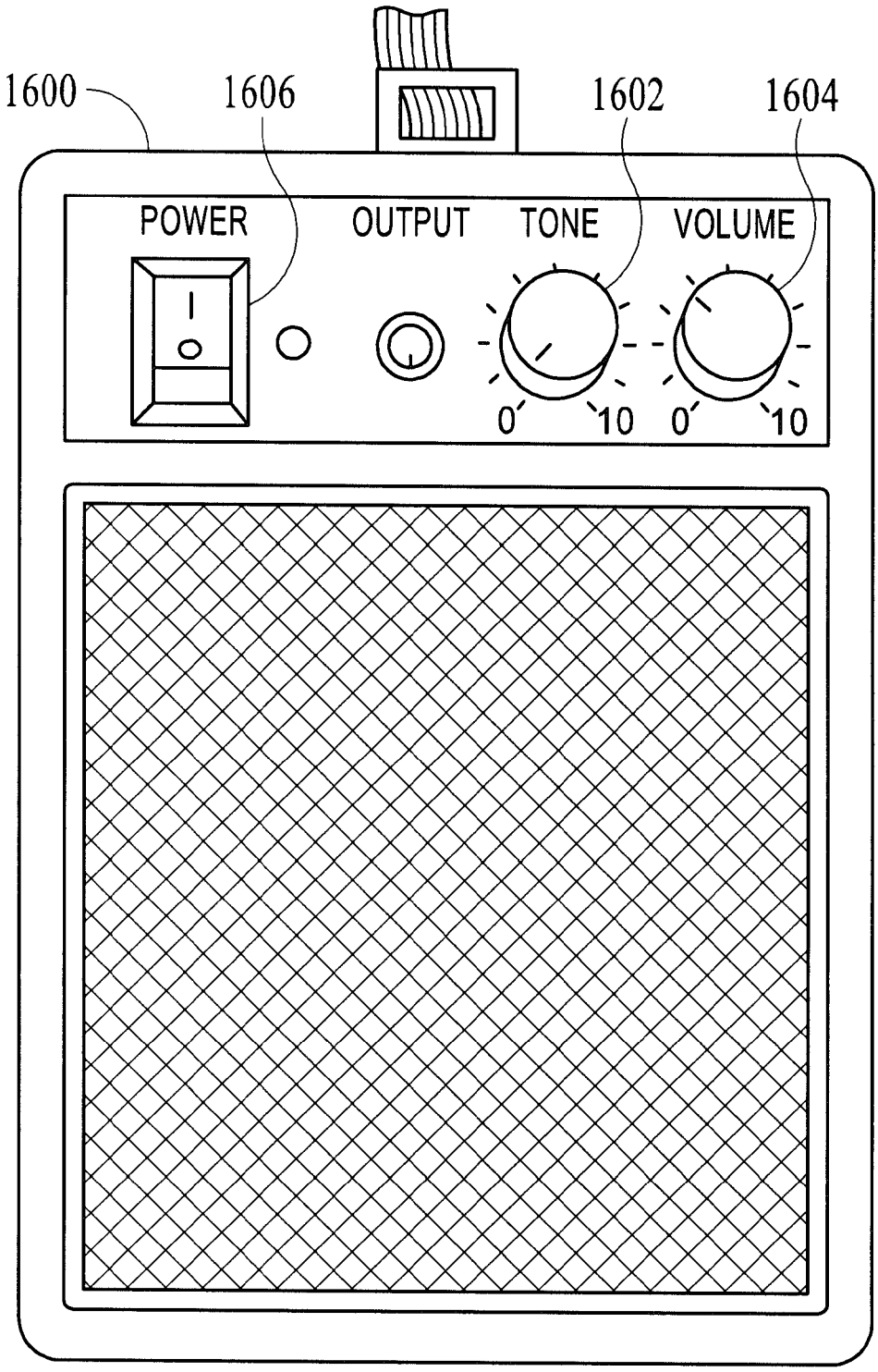
FIG. 16 illustrates a close up view of the amplifier used with the interactive garment, under an embodiment.

A close up view of the amp 1600 under an embodiment, is illustrated in FIG. 16. The amp can be provided in any size or shape depending on requirements and constraints, but is typically embodied within a housing that is of an appropriate size to be worn on a user's belt or hung from the shirt on a shoulder strap or similar attachment means. The amp can include some of the normal controls normally provided on a full size amplifier, such as controls for tone 1602 and volume 1604 and an on/off power switch 1606. The external speaker of the amp is coupled to the shirt using an audio interface that can be included in a standard audio cable (e.g., ¼" plug) or through the ribbon cable interface.

The embodiment illustrated in FIG. 2 illustrates an image of an electric guitar with pickups. The guitar could also be represented as an acoustic guitar, nylon string guitar, banjo, mandolin, sitar, or any similar stringed instrument. In this case, the pickup image could be replaced with a sound hole or similar image to indicate the portion of the image that is to be strummed by the user.

Keyboard Shirt

Figure 3:
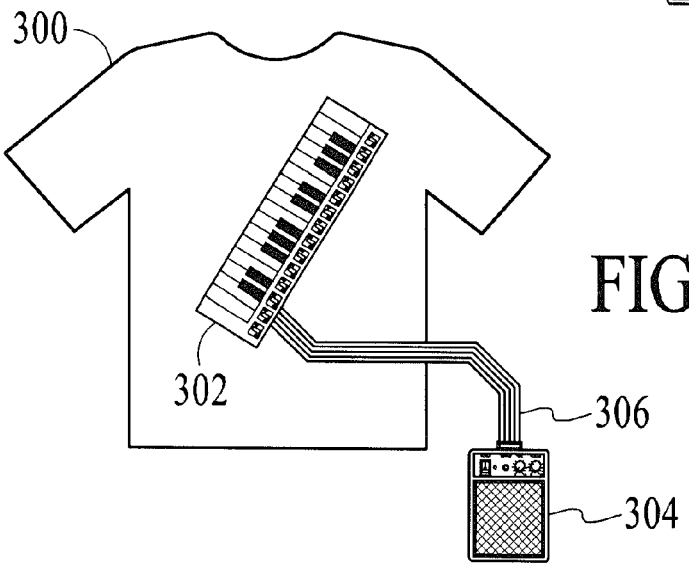
FIG. 3 illustrates a t-shirt that features a keyboard which can be played by the wearer, under an embodiment.

FIG. 3 illustrates a t-shirt that features a keyboard which can be played by the wearer. The keyboard t-shirt 300 has imprinted or incorporated on it an image of a keyboard (e.g., piano, organ, synthesizer, etc.) 302. The keyboard image is attached to a speaker and battery box 304 through cable assembly 306. The cable assembly 306 is typically placed on the inside of the shirt and the speaker and battery box can be hidden under the shirt and held in an interior pocket or otherwise attached to the wearer, such as on a belt, so that they are not readily visible. In an embodiment, the speaker 304 is a decorative speaker that is configured to miniature version of a full size amplifier. In this case, the amp 304 can be hooked on the wearer's belt or hung from his/her shoulder. The keyboard image 302 includes a number of white keys and black keys arranged as per a normal keyboard, such as, a piano, organ, or synthesizer.

Figure 6:
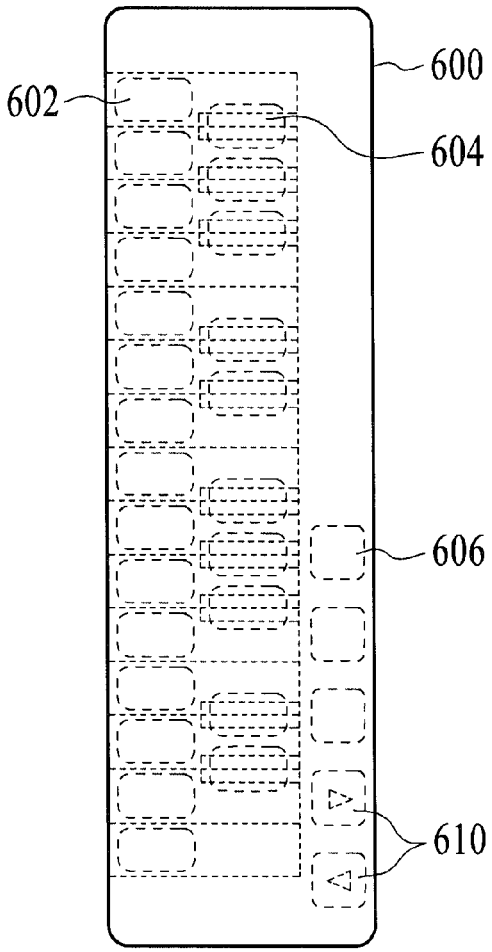
FIG. 6 illustrates the layout of the switches of the keyboard, under an embodiment.

The wearer plays the keyboard by pressing one or more keys, which will produce a specific note when activated. These button keys employ a flexible membrane sensor, such as illustrated in FIG. 8, to detect touch. FIG. 6 illustrates the layout of the switches of the keyboard. In an embodiment, the keyboard 600 includes a number of button regions 602 and 604 that are organized into areas defined by the individual keys of a normal keyboard. Thus, keys 602 correspond to the white keys on a regular keyboard, and keys 604 correspond to the black keys on a regular keyboard. Each button creates a different pitch and is actuated by a user pressing down on the appropriate button region. Sounds are heard through a built in speaker contained in a case which can be made to look like a miniature keyboard or guitar amp. This amp can then be stored in an internal pocket inside the shirt or worn on the belt with the attached clip. All electronics are able to be removed from the shirt to facilitate washing. Electronics are connected to the shirt using hook and loop fasteners so that they may be easily replaced by the user when washing is finished.

As shown in FIG. 6, each key of the keyboard represents an individual note of a piano in the standard musical scale. Depending on size constraints, an entire 88-key piano or any portion thereof, may be implemented on the shirt. The keyboard shirt may be played monophonically in which only a single key may be depressed at a time to sound one note at a time, or polyphonically in which multiple keys can be pressed simultaneously to play chords. The keyboard shirt can also include other switches 606 that modify the sounds generated by the shirt, such as to change the sound of the note (e.g., keyboard, organ, synthesizer, horn, strings, etc), change the octave 610, change the duration, or other similar effects, such as those provided by actual electronic keyboards.

Figure 14:
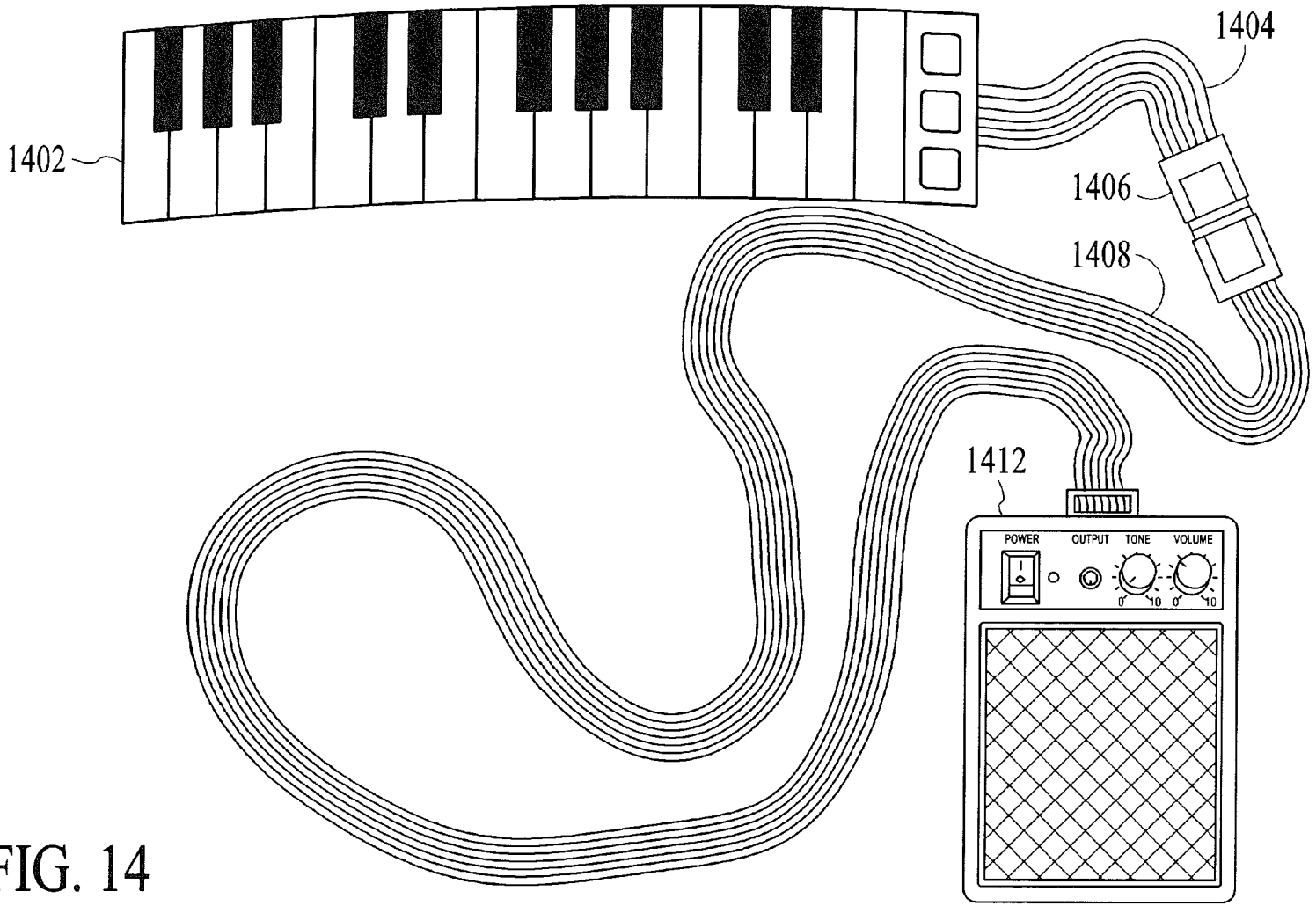
FIG. 14 illustrates the main components of the keyboard t-shirt illustrating the button panel, electronics and battery box and ribbon cable, prior to incorporation in the t-shirt or garment.

FIG. 14 illustrates the main components of the keyboard t-shirt illustrating the button panel, electronics and battery box and ribbon cable coupling the components together, prior to incorporation in the t-shirt or garment. As shown in FIG. 14, the main components include the keyboard 1402 that incorporates a key pad or button panel that comprises an array of switches with one switch per key. This is connected to a wearable mini amplifier 1412 through ribbon cable 1308 that is detachably coupled through interface 1406 to cable 1404. This allows the amp, electronics and battery box and ribbon cable be removed from the t-shirt when necessary. All of the electronics are able to be removed from the shirt to facilitate washing. The electronics are connected to the shirt using hook and loop fasteners so that they may be easily replaced by the user when washing is finished.

The embodiments illustrated in FIGS. 1-3 are examples of various types of instruments that can be represented for user input, and many other instruments are also possible. The type of instrument that is depicted can determine the type of sound that is generated, depending upon the sound generation and synthesis circuitry. For example, the sound generation circuit for a guitar can be configured to produce an electric guitar sound, and acoustic guitar sound, a nylon string guitar sound, and so on. Different effects, such as distortion or reverb can also be provided by sound effect circuitry or programming. In an alternative embodiment, the sound generation circuit could be configured to generate a generic musical sound (tone) regardless of the incorporated musical instrument image. The musical instrument shirt can also incorporate other output elements, such as lights. The lights can be configured to change color or intensity depending on the notes or keys that are being played.

Proximity Sensing Shirt

Figure 9:
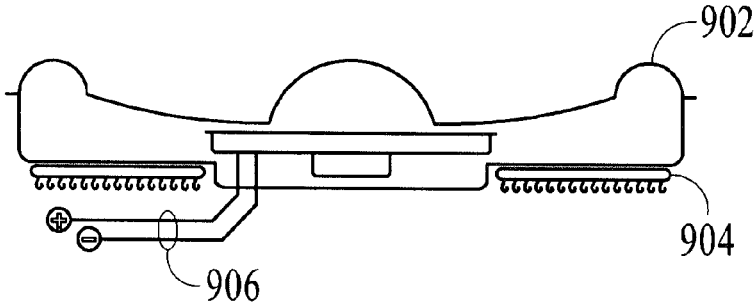
FIG. 9 illustrates a garment mounted speaker that is attached to a garment for use in conjunction with an interactive electronic apparel, under an embodiment.

The example instrument shirts of FIGS. 1-3 represent garments in which the primary output is audio and the primary input is a user activating one or more switches on a keypad incorporated in the instrument image. The garments can also be configured to primarily output light or color in response to either user input or other impulses or conditions. In one embodiment, the garment may incorporate a proximity detector which can be used to detect any other paired device via radio frequency or infrared. When another paired device is detected within range, the t-shirt will generate electronic sounds and/or light output. Sounds are heard through a built in speaker contained in an interior pocket of the shirt or sewn on to the interior or exterior surface of the shirt. In an embodiment, this is a standard speaker using an electroacoustic transducer that converts an electrical signal into sound. FIG. 9 illustrates a speaker component mounted within a garment and attached through hook and loop attachment means. As shown in FIG. 9, the speaker transducer element 902 is affixed to the garment fabric by attachment means, such as a hook and loop system. The embodiment of FIG. 9 illustrates the speaker component with the hook portion 904 of a hook and loop system. The garment (not shown) would have the loop portion for attachment of the speaker. The speaker component also includes electrodes 906 for connection to the electronics that generate the sound. This speaker may be a simple exposed transducer element as shown in FIG. 9, or it may alternatively be enclosed in an external plastic housing to improve appearance and provide a sounding box to increase speaker volume and improve sound quality.

Figure 15:
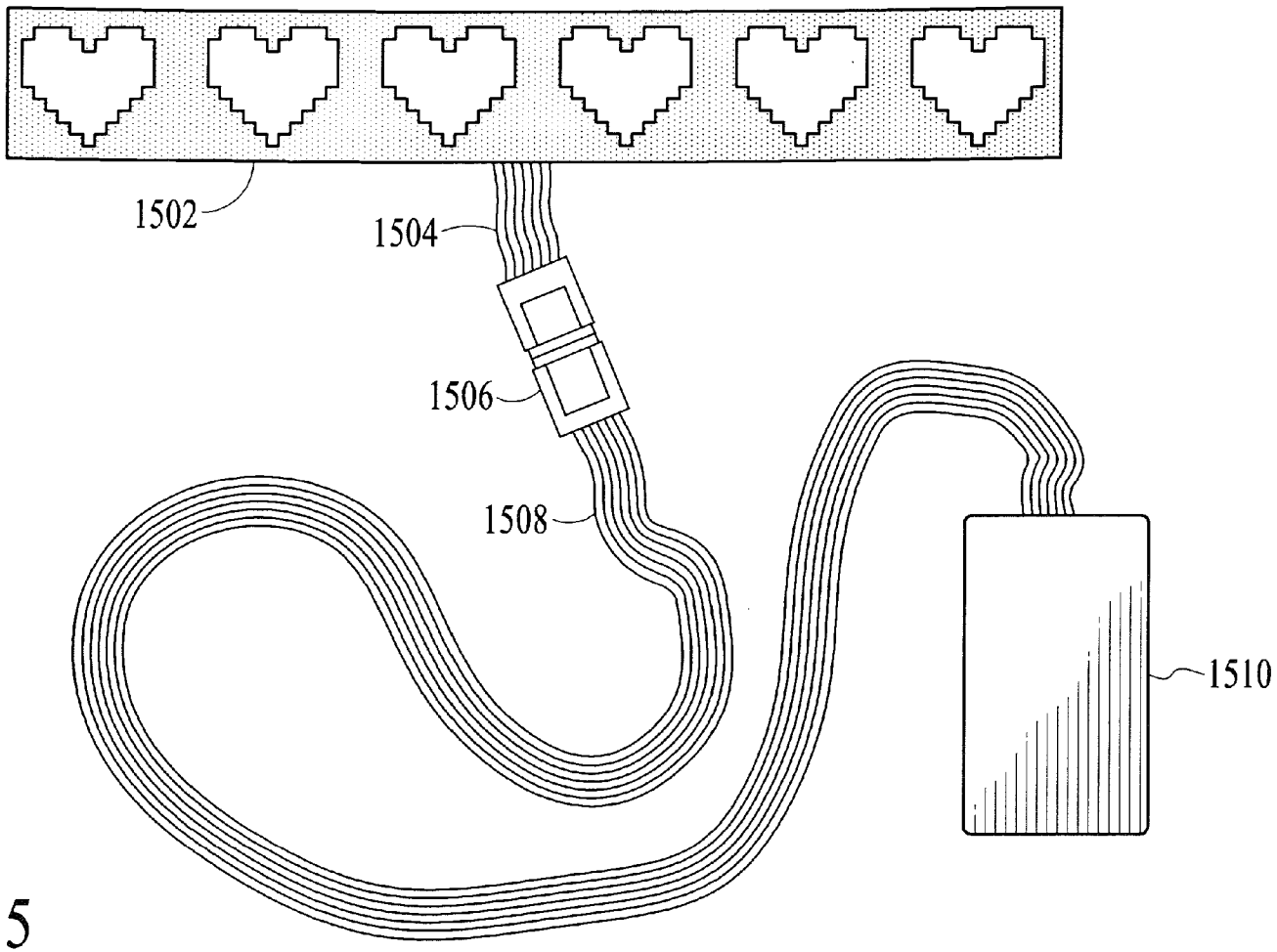
FIG. 15 illustrates the main components of the proximity t-shirt illustrating the light panel, electronics and battery box and ribbon cable coupling the components together, prior to incorporation in the t-shirt or garment.

FIG. 15 illustrates the main components of the proximity t-shirt, under an embodiment. The proximity shirt includes a light panel 1502, electronics and battery box 1510 and ribbon cable 1508 coupling the components together, prior to incorporation in the t-shirt or garment. For the proximity shirt shown in FIG. 15, the light panel 1502 is shown as a row of hearts. This panel can be configured to light up an increasing number of hearts as two people wearing the same shirt approach one another. Thus, if they are a defined distance away (e.g., 20 feet) one heart will light, and as they get closer, more hearts light up until they are right next to each other. Other patterns are also possible, such as radar screens, target detection indicators, bar levels, and the like. Alternatively, the proximity detector can be configured to detect the presence of an electromagnetic source, such as radio waves, television signals, cell phone site, WiFi hotspot, and the like. In this case, the light panel can be a level indicator, such as a bar level indicator or WiFi signal strength indicator that increases in brightness, sound, number of lights, etc., as the wearer gets closer to the transmitter. All electronics are able to be removed from the shirt to facilitate washing. Thus, the ribbon cable 1508 for the electronics is connected to the light panel cable 1504 through an interface 1506 that can be decoupled. Electronics are connected to the shirt using hook and loop fasteners so that they may be easily replaced by the user when washing is finished.

In the proximity sensing shirt proximity sensors are employed that are able to detect the presence of nearby objects without any physical contact. A proximity sensor often emits an electromagnetic or electrostatic field, or a beam of electromagnetic radiation (infrared, for instance), and looks for changes in the field or return signal.

Depending on the type of shirt that is implemented (i.e., instrument or proximity), various methods of signal input may be employed to implement the interactive electronic apparel, according to one or more embodiments. The following input devices can be used to activate the lights and sound output for a proximity or sound playback shirt. These include electromagnetic interference, in which a disturbance that affects an electrical circuit due to either electromagnetic conduction or electromagnetic radiation emitted from an external source is sensed and then used to produce a corresponding sound through the shirt. Radio frequency detection that relies on detection of radio frequency oscillation in an electronic circuit, or infrared detection using an infrared emitting LED and an infrared detecting photodiode can also be used as the basis of a proximity sensing shirt. Similarly, a magnetic sensor to detect a magnetic field can also be implemented.

Various other sensors can also be used, such as electro-optical sensors that convert the light rays in to electronic signal; photodiode sensor that are photodetectors capable of converting light into either current or voltage, depending upon the mode of operation; photoresistors or light dependent resistor or cadmium sulfide (CdS) cell that are resistors whose resistance decreases with increasing incident light intensity. Yet further additional sensors include audio sensor, such as microphones or acoustic-to-electric transducers that convert sound into an electrical signals, tilt sensor that can measure the tilting in often two axes of a reference plane in two axes; and accelerometers, which are devices that measures proper acceleration and can use these measurements to modify sound or light output.

Sound Generation

The output of the sound generating or proximity sensing shirts can be embodied in a number of different alternative implementations. The light bar or light output can be provided by LEDs (light emitting diodes) affixed to the garment, electroluminescent material that emits light in response to an electric current passed through it, or to a strong electric field, or similar light generating means.

The sound output is typically provided by internal (garment mounted) or external speakers. This sound output can be modified by one or more several techniques. These include volume controls that allow the user to adjust volume level of the generated sound, special effects that allow user to select special effects which will modify sounds, such as a "whammy" or vibrato bar that mimics variation of tension on guitar strings, or effects pedals that simulate the type of effects pedals currently used with electric guitars to modify the normal audio output of the device with echo, reverb, distortion, feedback or any other type of audio effect. Other output modification techniques include an instrument selector that allows a user to select various instrument sound types using an input device, and a tone/pitch selector that allows a user to select various tone/pitch options using an input device.

In an embodiment, the sounds for each instrument shirt or the proximity shirt are implemented in an electronic circuit board in the battery box of the shirt. This box contains batteries, speaker, and circuit board. It is designed to be stored in an internal pocket inside the shirt. The switches or sensor pads themselves trigger this box to play the sound. In an embodiment, the sound for each note or chord of an instrument is stored as recorded samples. Alternatively, the sound can be generated through FM waveform synthesis, or other similar means. In the case of the drum kit shirt, when the user pushes or hits a pad on the shirt, it triggers the appropriate sample to play depending on the button (drum or cymbal) pressed. In the case of the guitar shirt, when the user pushes a pad on the shirt and then strums the shirt with the magnetic pick, the circuit will play the corresponding chord. The synthesized sounds can be programmed into one or more circuit elements, such as programmable memory or programmable logic, or they may be provided as software that is executed by a processing unit (CPU).

In an embodiment, the sounds for the instrument represented on the garment are generated through digital sound samples that are stored or synthesized through the electronic circuit of the shirt. The sounds are recorded digitally from a sample of a real instrument and stored on a memory device (IC), and played back when the appropriate switch is activated. The sounds can be recorded in a recording process and converted from analog to digital format for storage in the circuit. Upon playback, the digital data is converted to analog for projection through the amplifier and speaker circuit.

Figure 10:
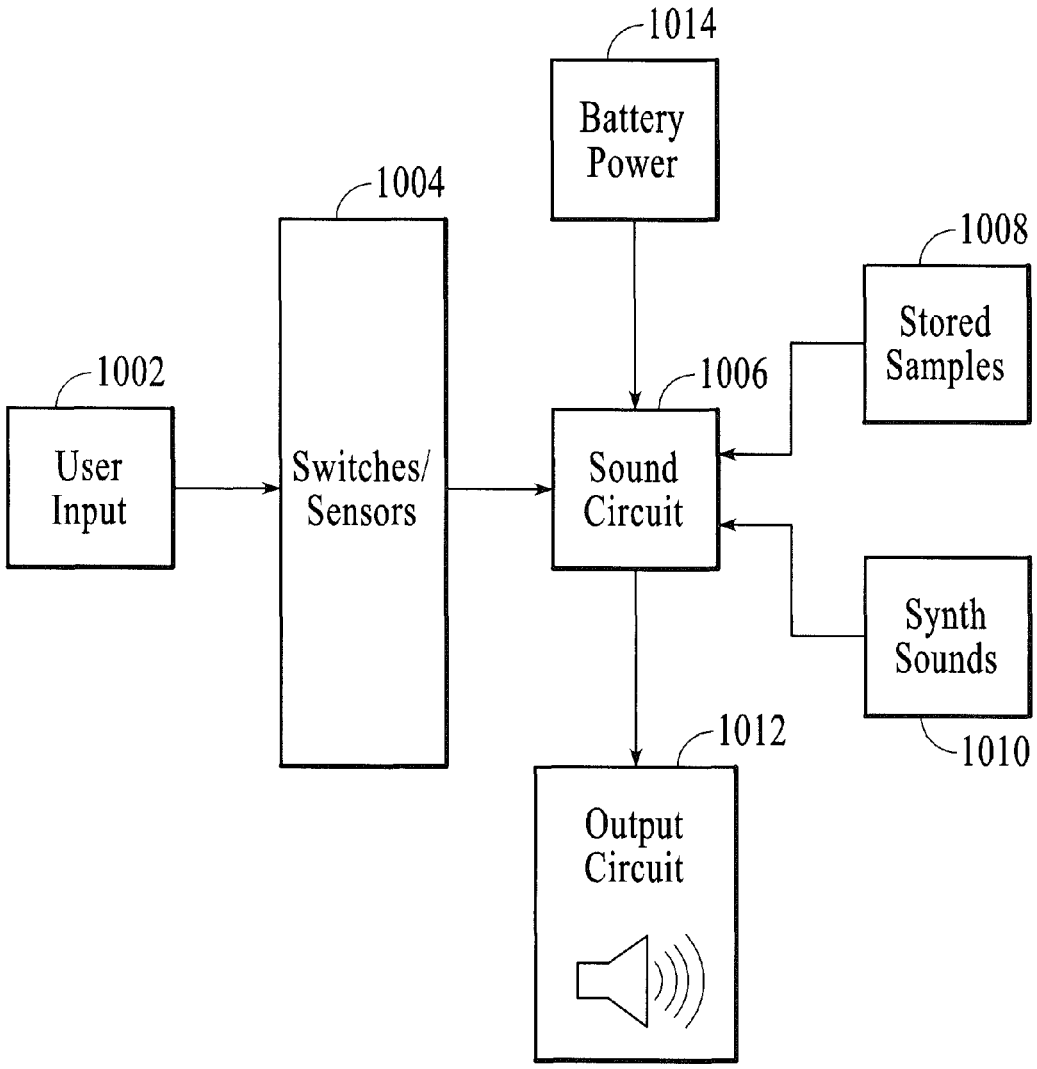
FIG. 10 is a block diagram illustrating the main components of the electronic apparel, under an embodiment.

FIG. 10 is a block diagram illustrating the main components of the electronic apparel, under an embodiment. As shown in FIG. 10, user input 1002 is provided to the switches and sensors 1004 in the shirt (or other object or article of clothing). The user input can be a single input motion or act, such as hitting, pressing, or tapping a key or drum, or it can be a multiple or combined input motion or act, such as pressing a button and strumming, or pressing two different buttons, etc. The signal from the depressed or activated switches/sensors 1004 are transmitted to a sound circuit 1006. The sound circuit generates the appropriate sound based on the type of instrument and the note or notes played by the user. The sounds can be provided in the form of sound samples 1008 that are stored in resident or off-board memory, or they may be synthesized 1010 by the resident circuitry. The sounds are then output through output circuit 1012, which includes one or more speakers, or connections to external speakers. In an alternative embodiment, the output circuit may comprise lights or other graphical output that is generated along with, or instead of the sound provided by sound circuit 1006. As shown in FIG. 10, the electronic garment (e.g., drum/guitar/keyboard shirt) contains one or more input sensors or switches which the user activates alone or in combination to produce a corresponding sound through a speaker, light array, or other output device or devices. The following methods can be used to connect input and output devices together: wired cables, Radio Frequency (RF) interface, and Infrared (IR) interface, among others.

Figure 11:
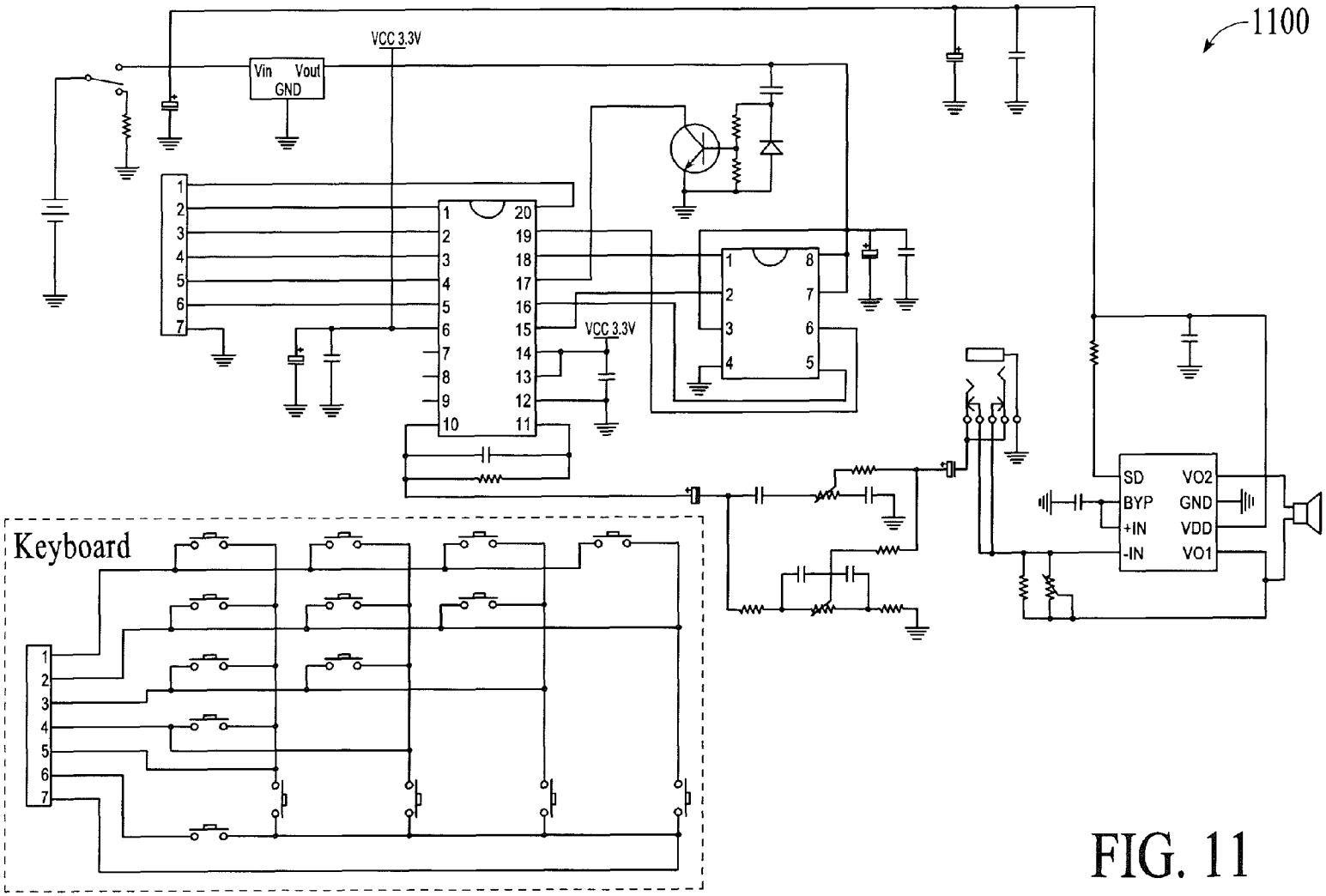
FIG. 11 is an example schematic diagram of the electronic components of an interactive electronic apparel, under an embodiment.

FIG. 11 is a schematic diagram of the electronic components of an interactive electronic apparel, under an embodiment. The schematic diagram of FIG. 11 is provided for illustration of a particular implementation of an electronic circuit for the block diagram of FIG. 10. The circuit 1100 illustrated in FIG. 11 comprises many standard electronic elements, such as resistors, capacitors, transistors, switches, diodes, IC devices, and so on, and is provided for illustrative purposes only. It will be appreciated by those of ordinary skill in the art, that many different circuits can be implemented to embody the block diagram of the system illustrated in FIG. 10. One or more of the integrated circuit (IC) devices of the circuit of FIG. 11 can be programmed to store and generate the synthesized sounds corresponding to the instrument and any special effects that are provided. These circuits can be programmed using techniques familiar to those of skill in the art.

In general, the electronic circuit within each shirt is embodied in a flat printed circuit and a battery box. Depending on how the sounds for each instrument are generated, each type of shirt may have its own dedicated electronic circuit. In this case, the electronics between shirts may not be interchangeable between shirts because each shirt has different dimension sensor pads and sound generation circuitry. Alternatively, such as if sound synthesis is used to generate the sounds, at least some electronics components, such as the sound generation and output circuits may be interchangeable among different types of shirts. Power to the circuit may be provided through any appropriate battery or battery pack, such as AA, AAA. 9 Volt batteries or any other portable battery source.

The electronics, speakers, and/or power supply/battery of the garment are generally affixed to the garment in such a way as to allow for washing of the garment without damage to the electronic apparatus. In this way the non-washable electronic components of the garment are able to be removed, the garment separately washed, and then the electronic components can be replaced by the end user of the garment.

In one embodiment, the electronics can be affixed by means of hook and loop fasteners in which one layer of fabric consisting of tiny hooks and one layer of fabric consisting of smaller loops are used and when the two sides are pressed together, the hooks catch onto the loops, holding the pieces together. Another affixing means includes magnetic fasteners, in which a pair of magnets used to secure the electronics to the garment. One magnet is affixed permanently to an object on the outside of the garment. The second magnet is then placed on the inside of the garment. The two magnets attract each other causing the object on the outside of the garment to be held in place by friction. Yet another affixing means comprises a sewn-in pocket, in which a fabric pocket is sewn into the garment and is used to hold the electronics to within the garment. In another embodiment, a sewn-in sealed pocket can be used. This is a pocket that is sewn into the garment, but is sealed permanently to allow for regular washing without damage to electronics. In this sewn-in sealed embodiment, the electronics and power supplies can be encased within the garment or within a waterproof section of the garment in such a way as to ensure protection against prolonged exposure or soaking in water. For example, they can be sewn into the garment in a rubberized or otherwise waterproof compartment, and the switches can be made waterproof.

Other affixing means include snap fasteners using standard snap closures featuring a pair of interlocking discs in which a circular lip under one disc fits into a groove on top of the other, or buttons that secure an opening by slipping through a fabric of thread loop. Laces or temporary stitches can also be used to affix the electronics to the garment. Another affixing means include adhesives or glues, such as a sticky elastomer that permanently affixes the garment with a sheet of sticky elastomer rubber material. In this case, the electronic parts with a smooth surface can be stuck to the elastomer and held by surface tension, and the electronic parts can be peeled off of the elastomer to facilitate washing of the garment.

Figure 17:
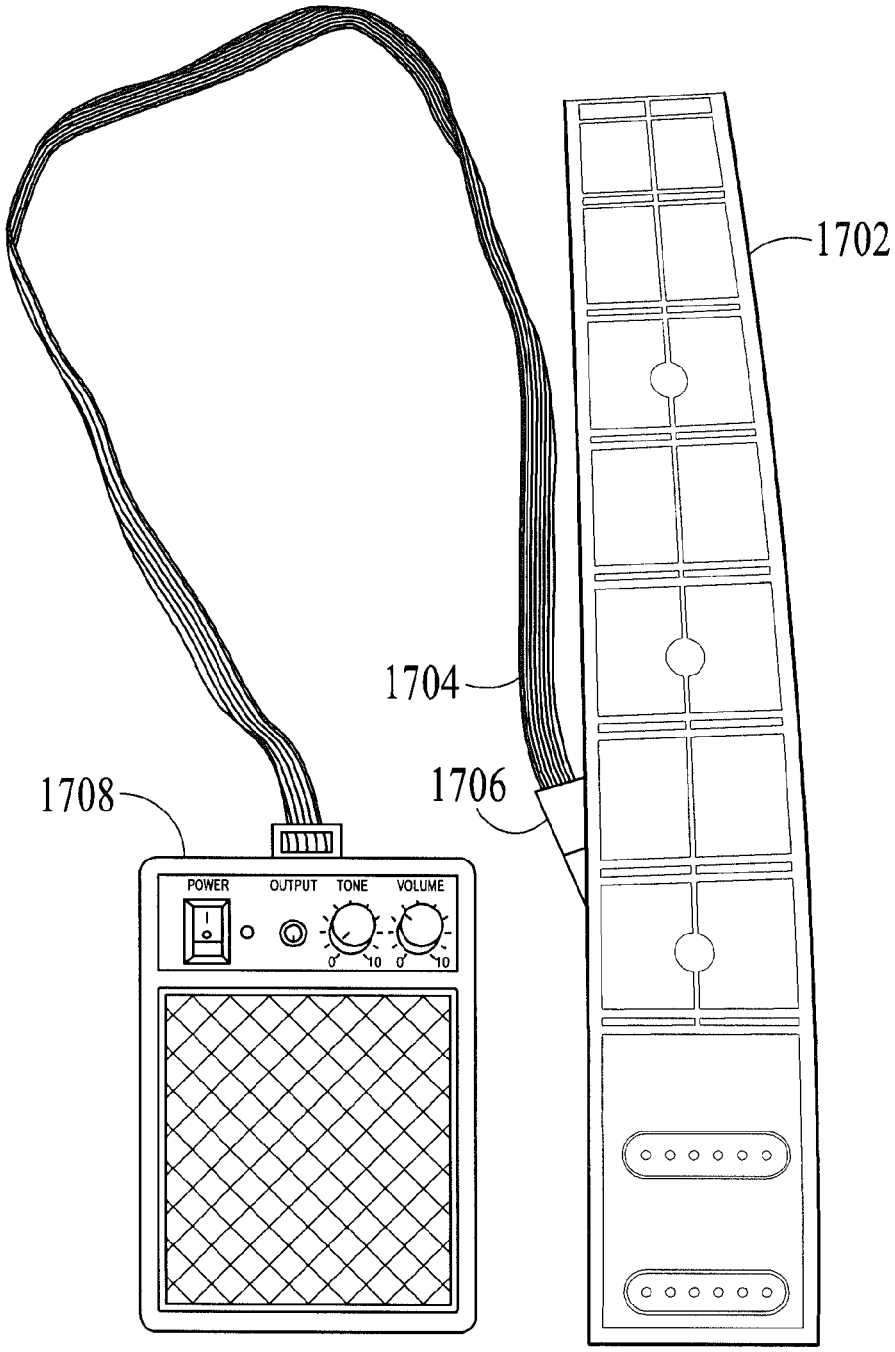
FIG. 17 illustrates a top view of the keypad portion of the guitar shirt connected to a mini amp, under an embodiment.

In an embodiment, the keypad portion of the instrument (e.g., drums, guitar, keyboard) is embodied in a plastic or vinyl sheet that is affixed to the front of the garment and attached to the garment through hook and loop or similar affixing means. The keypad portion includes the switches that are pressed or actuated by the user and are represented as the analogous portion (fret board, keypad, drum/cymbal, etc) of the instrument represented on the garment. FIG. 17 illustrates a front view of the keypad portion of the guitar shirt connected to a mini amp, under an embodiment. The fret board 1702 portion of the guitar is a plastic or equivalent component that is affixed to the front of the shirt by a hook and loop, or equivalent, attachment means. It is connected to the electronic circuit, power and amplifier 1708 through a wire array, ribbon cable 1704, or similar attachment means. The cable or wire runs along the inside of the shirt to the amplifier 1708 and is coupled to the switches in the fretboard through a pin-connector, or equivalent electrical/mechanical coupling 1706.

Figure 18:
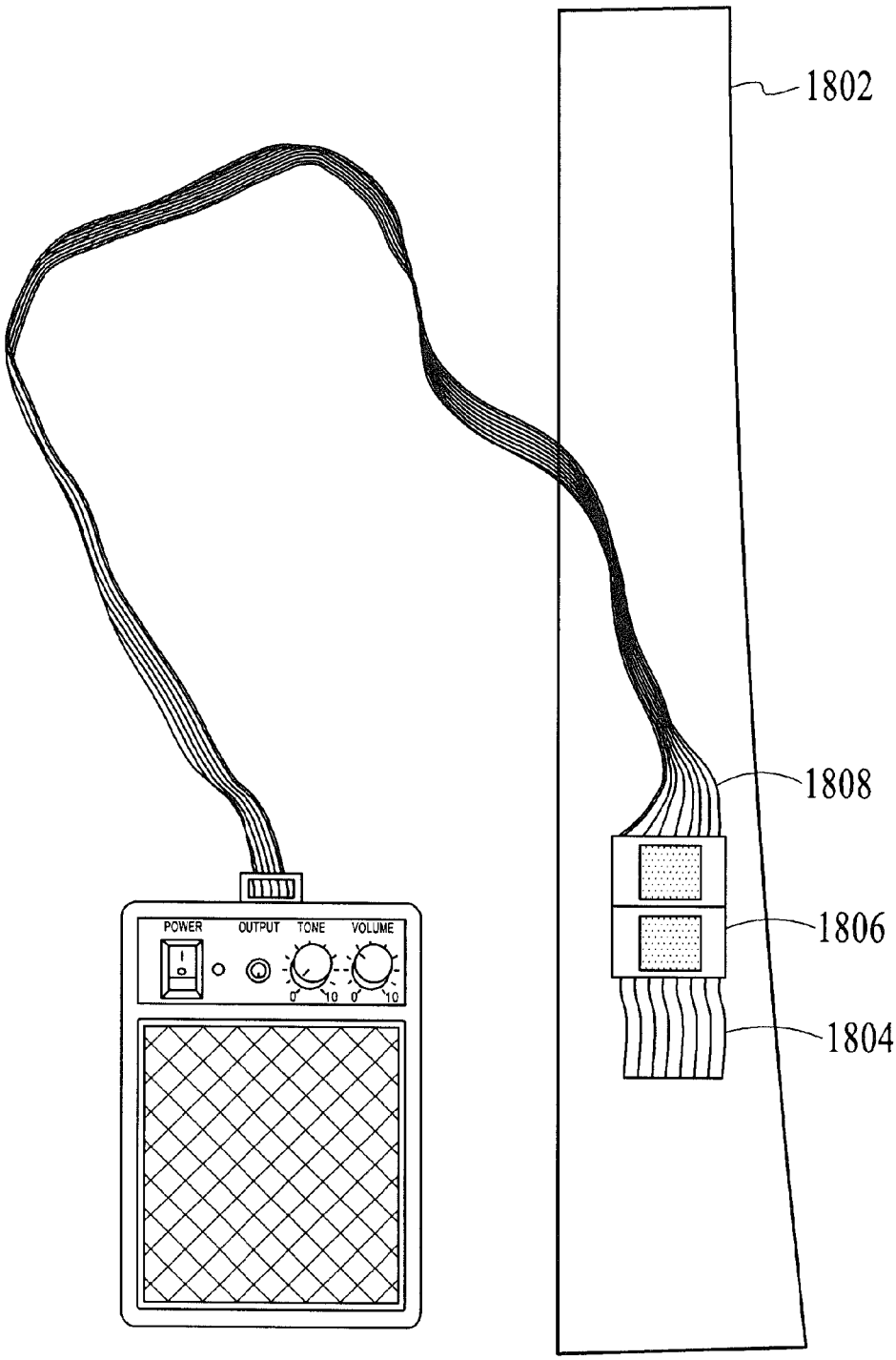
FIG. 18 illustrates a back view of the keypad portion of the guitar shirt connected to a mini amp, under an embodiment.

FIG. 18 illustrates a back view of the keypad portion of the guitar shirt connected to a mini amp, under an embodiment. The back side of the fret board 1802 has a portion of the hook and loop connector glued or affixed, and mates to the complementary portion that is attached to the surface of the garment. The detachable coupling 1806 is shown in a coupled state so that the keypad cable 1804 is coupled to the ribbon cable 1808. When the coupling is decoupled, the amp and electronics portion can be removed, and the fretboard can be removed from the garment. This allows the garment to be washed without harming any of the electronics or switches.

Figure 19:
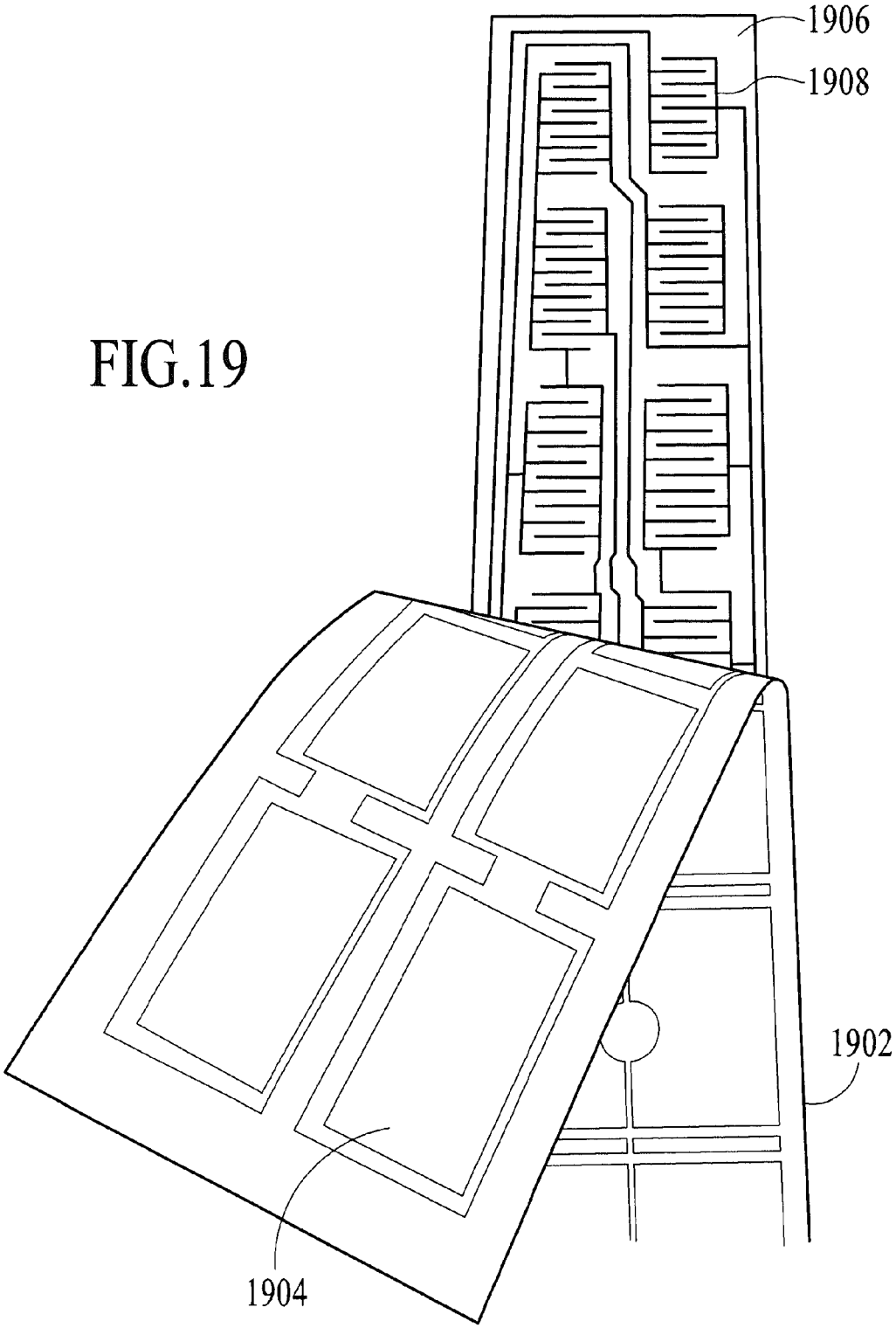
FIG. 19 illustrates the switches and sensor pad areas of the fretboard for the guitar shirt, in an embodiment

In an embodiment, the switches of the electronic garment that are embodied in the fretboard, keyboard, drums, and so on of the shirt are coupled to the detachable coupling through a flat ribbon connector, as shown in FIG. 18. FIG. 19 illustrates the switches and sensor pad areas of the fretboard for the guitar shirt, in greater detail. The fret board 1902 is made of a flexible material (e.g., vinyl, Mylar, plastic, and the like) and contains one or more conductive areas 1904 that define the notes or chords that can be played on the shirt. The guitar also includes a switch matrix 1906 that contains switches 1906 that are activated when the user presses the corresponding switch areas 1904 on the fret board keypad 1902.

In general, the switches in the switch matrix 1906 for the guitar shirt comprise touch sensors that are sensors capable of sensing when it is touched by a person or object or friction. Such as touch sensor may be embodied in a flexible membrane switch, such as that shown in FIG. 8. As shown in FIG. 8, this type of switch comprises a membrane pad that basically consists of three layers; two of these are membrane layers containing conductive traces. The center layer is a "spacer" containing holes wherever a "key" or guitar note exists, and keeps the other two layers apart. The switch can incorporate a force sensor that is capable of receiving and measuring various degrees of force by either being pushed or pulled, and can be used to control the volume or timbre of a note as it is played on the shirt. Other types of switches that can be used in the switch array include pressure sensors in which a trigger (pad) is activated by weight, or a capacitive (touch) sensor, which is a type of switch that only has to be touched by an object to operate by detecting changes in capacitance; or a resistive sensor in which two or more metallic contacts are attached to a device in such a way that they do not touch each other. When a metal object, human hand or other conducting item touches two or more of these contacts it completes a low voltage circuit. The amount of electricity flowing through one contact, out into the external object and back into another contact is measured to determine the resistance level. This resistance level is then used to determine whether the contacts have been touched.

In general, any appropriate type of switch may be used for the keypad or switch pad portion of the instrument image. These include piezoelectric switches that produce a momentary on pulse by turning on a transistor switch by stresses that generate an electric charge, optical sensors (e.g., visible light or infrared), capacitive or inductive touch switches, ultrasonic range finders, sound sensors, or any similar type of switch. The switches are typically implemented as momentary 'on' switches such that a sound is generated only when the switch is pressed or activated by the user, and is only on for the duration that the switch is pressed. Thus, the duration of a sound or note depends on the length of time that a user presses the switch. The switch may also incorporate a volume control so that the volume or intensity of the sound generated depends on the amount of pressure that the user applies to the switch.

In general, the switches of the keypad are organized in an array that corresponds to the instrument image. Thus, the keypad for the guitar comprises an array of switches that are organized along the lines of the fret board, as shown in FIG. 5; the keypad for the keyboard comprises an array of switches organized along the lines of the keyboard, as shown in FIG. 6, and the switches for the drums can be organized in the shape of the drum kit shown in FIG. 4, with one switch per drum or cymbal. Similarly, if the instrument embodied in the interactive shirt is a saxophone, trumpet, xylophone, or any other instrument the key or switch pad can be arranged so that the switches are arranged in correspond to the user input area of the instrument.

Figure 20:
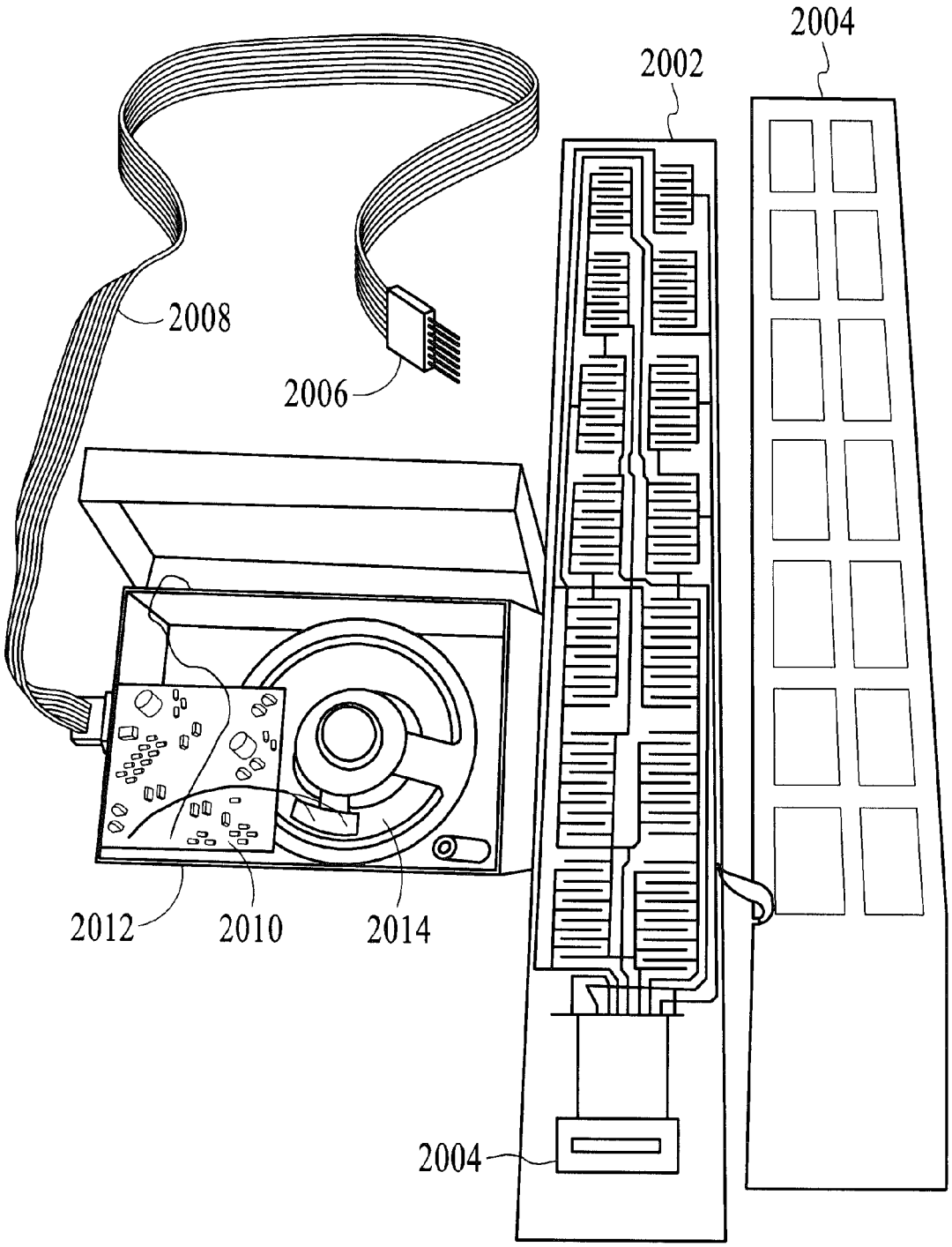
FIG. 20 illustrates the switches and sensor pad areas of the fretboard for the guitar shirt in a separated state along with the internal components of the electrical circuit and amp, in an embodiment.

FIG. 20 illustrates the switches and sensor pad areas of the fretboard for the guitar shirt in a separated state along with the internal components of the electrical circuit and amp, in an embodiment. FIG. 20 illustrates the entire internal portion of the switch matrix 2002 when it is separated from the keypad portion 2004 of the guitar fret board. The switch matrix 2002 includes an interface 2004 that couples to the amplifier ribbon cable 2008 by mating to plug 2006. FIG. 20 illustrates the internal components of amplifier 2012 as including speaker element 2014 and circuit board 2010.

Figure 21:
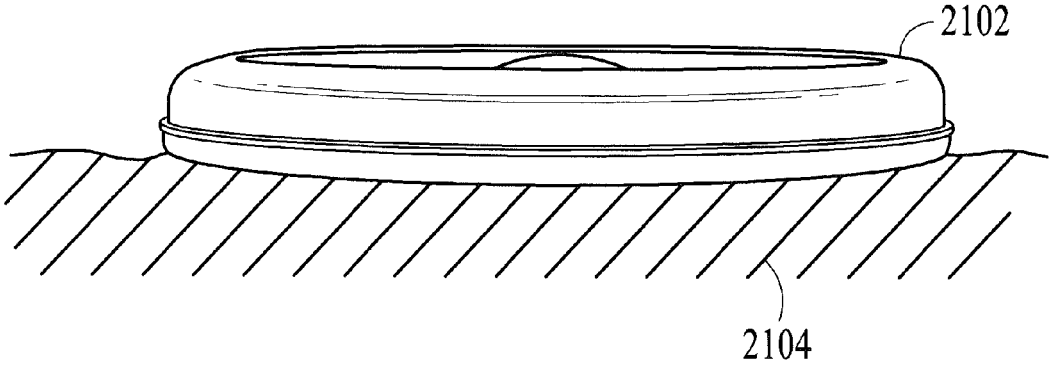
FIG. 21 illustrates a side view of a speaker unit that is provided as part of the garment, under an embodiment.
Figure 22:
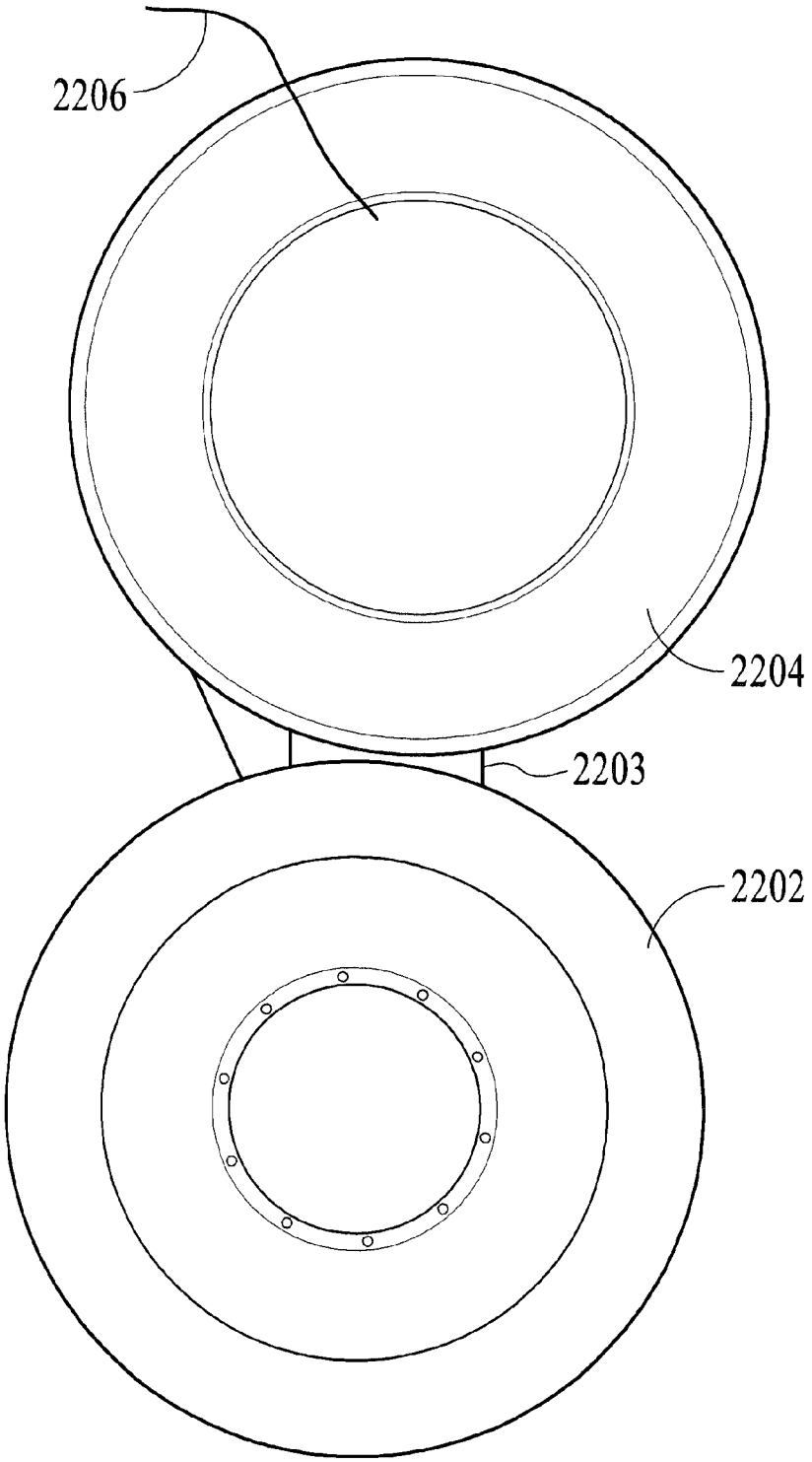
FIG. 22 illustrates a front view of the integrated speaker of FIG. 21.

The amplifier and speaker system can be provided as a standalone unit that is detachably coupled to the garment, as shown in FIG. 16, or the amplifier/speaker unit may be incorporated in the garment. FIG. 21 illustrates a side view of a speaker unit that is provided as part of the garment, under an embodiment. The speaker cone 2102 protrudes above the surface of the garment 2104 and may be mounted so that it faces outward from the garment. Alternatively, it can be mounted to face the inside of the garment. The speaker system can be made of two components that mount the speaker to the garment. FIG. 22 illustrates a front view of the integrated speaker of FIG. 21. The speaker comprises the speaker cone 2102 that protrudes above the surface of the garment, and backing portion 2204 that affixes to the back surface of the garment below the speaker cone and helps to hold the speaker cone in place. The illustration of FIG. 22 shows the two components in an open position relative to a flexible hinge 2203 and when affixed to the garment the hinge is closed so that the two parts are coupled together. A pair of speaker wires 2206 passes through the back of the backing portion 2204 for connection to the sound generating electronics.

Figure 23:
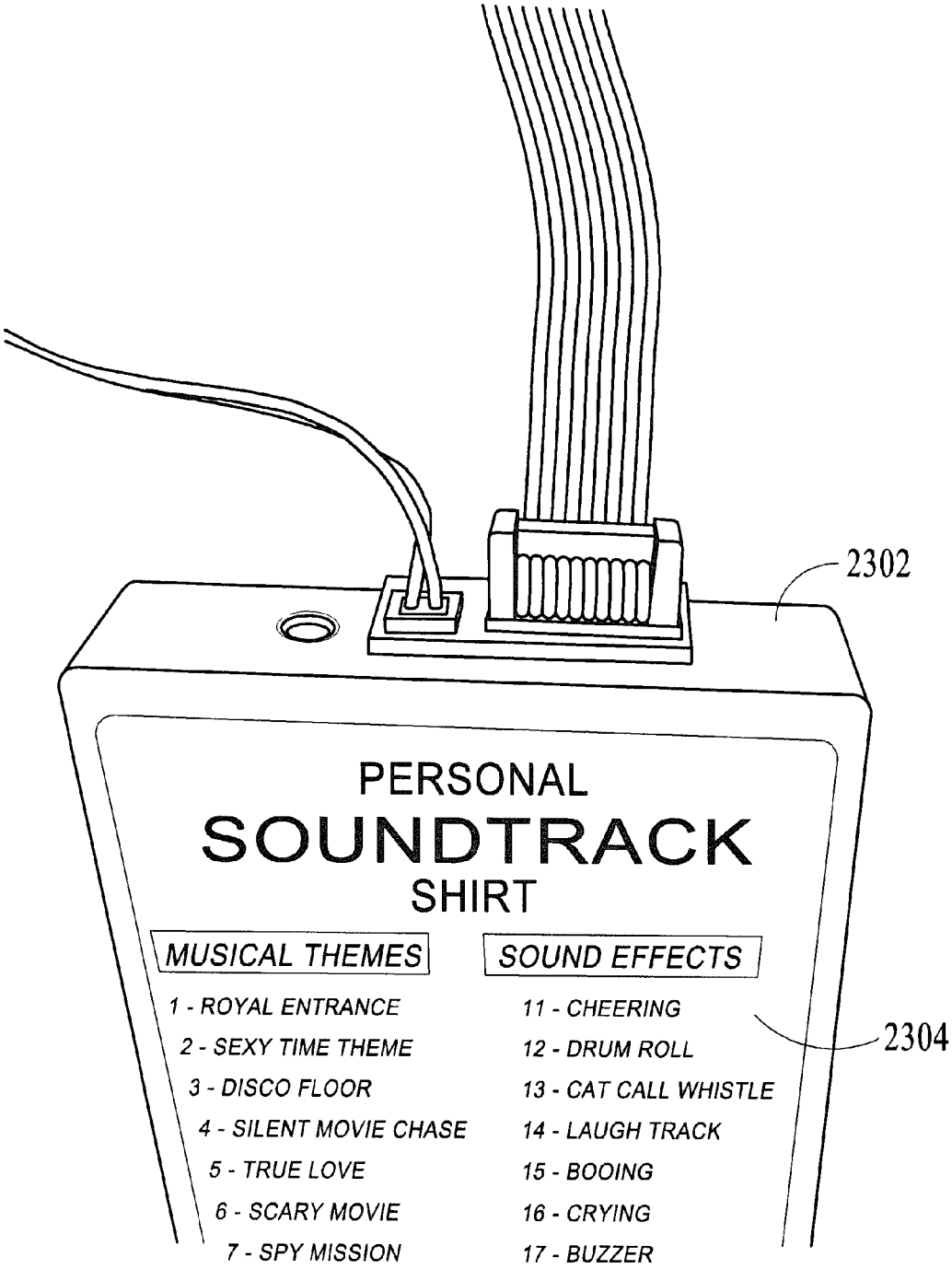
FIG. 23 illustrates the control box for a personal soundtrack shirt, under an embodiment.

Although embodiments have been described in relation to electronic garments that comprise musical instruments, many other variations are possible. For example, the garment can be configured to generate or play any type of noise or sound in response to user input. FIG. 23 illustrates the control box 2302 for a personal soundtrack shirt, under an embodiment. In this case, predefined sounds are stored within a memory and/or generated by a synthesizer circuit that is controlled by user input. Upon activating a switch, or making an appropriate movement, a corresponding sound can be generated and played back through an amplifier/speaker system. Various sounds can be generated as shown on the printed list 2304, such as songs, song clips, themes, sound effects, random noises, white noise, and so on.

Embodiments described herein are directed to an electronic garment comprising a graphical representation of an instrument provided on the surface of a wearable garment; an array of one or more switches and/or sensors located in the garment and beneath the graphical representation; an electronic sound circuit detachably coupled and integrated on an inside surface of the wearable garment and configured to generate a sound upon activation of a switch by a user, the sound corresponding to the type of instrument represented and the switch pressed by the user; and an output circuit configured to output the sound generated. The instrument may be one of: a drum kit, a keyboard, a guitar, and a saxophone. The output circuit includes one or more speaker elements. The speaker elements may be incorporated within the garment, or they may be provided in an enclosure that is detachably coupled to the garment, or to the user. The generated sound may comprise a pre-defined and pre-stored sample stored in a memory coupled to the electronic sound circuit. Alternatively, the generated sound may comprises a synthesized sound generated by a sound synthesizer circuit coupled to the electronic sound circuit. In the case wherein the instrument comprises a guitar, the one or more switches comprises a plurality of switches denoting individual notes or chords to be played, and a sensor to sense when the user strums the guitar represented on the garment. The guitar sensor may comprise magnetic reed switch, and the user input for strumming is provided by a magnetic pick. The switches may comprise flexible membrane buttons affixed to the underside of the garment proximate the instrument representation that deform to make/break contact when depressed by the user. The sound circuit may be detachably coupled through hook and loop connectors, magnetic connections, internal pockets, snap fasteners, or adhesive means. The electronic garment may further comprise one or more light elements configured to provide visual output in response to the user input. The electronic garment may further comprise one or more proximity sensors that produce a graphic or audio output in response to sensing the proximity of a device or other garment with a corresponding proximity sensor. Power may be provided to the circuits and output devices of the garment through batteries provided in the garment or coupled to the garment through a power interface.

Aspects of the electronic garment described herein may be implemented as functionality programmed into any of a variety of circuitry, including programmable logic devices ("PLDs"), such as field programmable gate arrays ("FPGAs"), programmable array logic ("PAL") devices, electrically programmable logic and memory devices and standard cell-based devices, as well as application specific integrated circuits. Some other possibilities for implementing aspects of the method include: microcontrollers with memory (such as EEPROM), embedded microprocessors, firmware, software, etc. Circuits may be provided in the form of printed circuit boards, flat ribbon circuitry, and other circuit manufacturing processes. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above description of illustrated embodiments of the electronic garment is not intended to be exhaustive or to limit the embodiments to the precise form or instructions disclosed. While specific embodiments of, and examples for, the newsletter hosting and transmission system are described herein for illustrative purposes, various equivalent modifications are possible within the scope of the described embodiments, as those skilled in the relevant art will recognize.

The elements and acts of the various embodiments described above can be combined to provide further embodiments. These and other changes can be made to the electronic garment in light of the above detailed description.

In general, in any following claims, the terms used should not be construed to limit the described system to the specific embodiments disclosed in the specification and the claims, but should be construed to include all operations or processes that operate under the claims. Accordingly, the described system is not limited by the disclosure, but instead the scope of the recited method is to be determined entirely by the claims.

While certain aspects of the described embodiments may be presented in certain claim forms, the inventor contemplates the various aspects of the methodology in any number of claim forms. For example, while only one aspect of the system is recited as embodied in machine-readable medium, other aspects may likewise be embodied in machine-readable medium. Accordingly, the inventor reserves the right to add additional claims after filing the application to pursue such additional claim forms for other aspects of the described systems and methods.

What is claimed is:

1. An apparatus comprising:

a shirt;

an image of a keyboard instrument incorporated onto a front surface of the shirt, the keyboard having a keypad providing an interface to an array of contact switches configured to be activated by a user while the user is wearing the shirt;

a sound generation circuit coupled to the array of contact switches and configured to generate a respective tonal sound for each switch of the array of contact switches;

a miniature amplifier coupled to the sound generation circuit, the miniature amplifier detachably coupled to the switch matrix through a cable and detachable coupling.

2. The apparatus of claim 1 wherein the tonal sound generated by each switch of the array of contact switches comprises a single monotonic note.

3. The apparatus of claim 1 wherein the tonal sound generated by each switch of the array of contact switches corresponds to a multi-note chord.

4. The apparatus of claim 1 wherein the array of contact switches comprises a plurality of switches selected from the group consisting of: piezoelectric switches, capacitive touch switches, inductive touch switches, and momentary contact switches.

5. The apparatus of claim 1 wherein the sound generation circuit further includes a sound effect circuit that modifies the tonal sound, and wherein the sound effect is selected from the group consisting of: reverb, delay, distortion, tremolo, and vibrato.

6. The apparatus of claim 1 wherein the keyboard instrument is selected from the group consisting of: piano, organ, synthesizer, and harpsichord.

7. The apparatus of claim 1 wherein the keyboard portion is detachably coupled to the shirt through attachment means selected from the group consisting of: hook and loop attachments, adhesives, laces, and snap fasteners.

8. The apparatus of claim 7 wherein the shirt includes an interior pocket to hold the miniature amplifier.

9. The apparatus of claim 1 further comprising a speaker element sewn into the fabric of the shirt wherein at least a portion of the speaker protrudes from a surface of the shirt.

10. The apparatus of claim 1 further comprising a light emitting diode (LED) array configured to output light when the sound generation circuit produces a tonal sound.

11. The apparatus of claim 1 further comprising a power supply providing power to the sound generation circuit and miniature amplifier, the power supply selected from the group consisting of: a battery array and a solar cell array.

12. An apparatus comprising:

a flexible keypad configured to be detachably coupled to a surface of a garment, and configured to represent a keyboard portion of a keyboard instrument;

an array of contact switches proximate the keypad structure and including a plurality of switches, each switch contained in a separate respective location of the keyboard portion;

a sound generation circuit coupled to the array of contact switches and configured to generate a respective tonal sound for each switch of the array of contact switches;

a miniature amplifier coupled to the sound generation circuit, the miniature amplifier detachably coupled to the switch matrix through a cable and detachable coupling.

13. The apparatus of claim 12 wherein flexible keypad is configured to be attached to the front of the garment, and wherein the plurality of switches is configured to be activated by a user while the user is wearing the garment.

14. The apparatus of claim 13 wherein the flexible keypad, array of contact switches, sound generation circuit, and miniature amplifier are configured to be removed from the garment when the garment is subject to washing.

15. The apparatus of claim 14 wherein the flexible keypad is detachably coupled to the garment through attachment means selected from the group consisting of: hook and loop attachments, adhesives, laces, and snap fasteners.

16. The apparatus of claim 15 wherein the keyboard instrument is selected from the group consisting of: piano, organ, synthesizer, and harpsichord.

17. The apparatus of claim 16 wherein the sound generation circuit further includes a sound effect circuit that modifies the tonal sound, and wherein the sound effect is selected from the group consisting of: reverb, delay, distortion, tremolo, and vibrato.

18. The apparatus of claim 12 wherein the garment is selected from the group consisting of: t-shirt, polo shirt, sweatshirt, sweater, and jacket.

* * * * *